US009323168B2

(12) United States Patent
Mori et al.

(10) Patent No.: US 9,323,168 B2
(45) Date of Patent: Apr. 26, 2016

(54) YELLOW TONER AND PROCESS FOR PRODUCING THE YELLOW TONER

(71) Applicant: CANON KABUSHIKI KAISHA, Tokyo (JP)

(72) Inventors: Shosei Mori, Hiratsuka (JP); Takeshi Sekiguchi, Tokyo (JP); Taichi Shintou, Saitama (JP); Yuko Katsumoto, Yokohama (JP); Takayuki Ujifusa, Ashigarakami-gun (JP); Takeshi Miyazaki, Ebina (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/376,227

(22) PCT Filed: Mar. 6, 2013

(86) PCT No.: PCT/JP2013/056882

§ 371 (c)(1),
(2) Date: Aug. 1, 2014

(87) PCT Pub. No.: WO2013/133449

PCT Pub. Date: Sep. 12, 2013

(65) Prior Publication Data

US 2015/0037725 A1 Feb. 5, 2015

(30) Foreign Application Priority Data

Mar. 7, 2012 (JP) ..... 2012-049897

(51) Int. Cl.
*G03G 9/09* (2006.01)
*G03G 9/087* (2006.01)
*G03G 9/08* (2006.01)

(52) U.S. Cl.
CPC ..... *G03G 9/091* (2013.01); *G03G 9/0804* (2013.01); *G03G 9/0806* (2013.01); *G03G 9/08708* (2013.01); *G03G 9/08755* (2013.01); *G03G 9/0912* (2013.01)

(58) Field of Classification Search
None
See application file for complete search history.

(56) References Cited

U.S. PATENT DOCUMENTS 5,346,797 A 9/1994 Kmiecik-Lawrynowicz et al.
6,106,986 A 8/2000 Shirai et al.

(Continued)

FOREIGN PATENT DOCUMENTS

JP 62-169167 A 7/1987
JP 3-42676 A 2/1991

(Continued)

OTHER PUBLICATIONS

Translation of JP 2011-257706 published Dec. 2011.*

(Continued)

*Primary Examiner* — Peter Vajda
(74) *Attorney, Agent, or Firm* — Fitzpatrick, Cella, Harper and Scinto

(57) ABSTRACT

A yellow toner is provided which is superior in dispersibility of C. I. pigment yellow 185, has a high color development property, and is superior in light resistance. The yellow toner has toner particles containing at least a binder resin, a wax, and a colorant, wherein the yellow toner contains C.I. pigment yellow 185 and a compound represented by the general formula (1) as the colorant:

General formula (1)

3 Claims, 1 Drawing Sheet

(56) References Cited

U.S. PATENT DOCUMENTS

| | | | | |
|---|---|---|---|---|
| 6,187,495 | B1 | 2/2001 | Chiba et al. | |
| 7,833,685 | B2 | 11/2010 | Tanaka et al. | |
| 8,211,606 | B2 | 7/2012 | Murai et al. | |
| 2010/0035171 | A1 * | 2/2010 | Watanabe et al. | 430/108.23 |
| 2014/0080049 | A1 | 3/2014 | Ujifusa et al. | |
| 2014/0134531 | A1 | 5/2014 | Mori et al. | |
| 2014/0170552 | A1 | 6/2014 | Shintou et al. | |
| 2014/0170553 | A1 | 6/2014 | Mori et al. | |

FOREIGN PATENT DOCUMENTS

| | | | | | |
|---|---|---|---|---|---|
| JP | 6-118715 | A | | 4/1994 | |
| JP | 6-250439 | A | | 9/1994 | |
| JP | 7-140716 | A | | 6/1995 | |
| JP | 2000-162824 | A | | 6/2000 | |
| JP | 2000-214638 | A | | 8/2000 | |
| JP | 2005-106932 | A | | 4/2005 | |
| JP | 2005-283725 | A | | 10/2005 | |
| JP | 2006-313302 | A | | 11/2006 | |
| JP | 2011-257706 | | * | 12/2011 | G03G 9/09 |
| JP | 2011-257706 | A | | 12/2011 | |
| JP | 2011-257707 | A | | 12/2011 | |
| WO | 2008/069045 | A1 | | 6/2008 | |
| WO | 2008/114886 | A1 | | 9/2008 | |
| WO | 2009/088034 | A1 | | 7/2009 | |
| WO | WO 2009/088034 | | * | 7/2009 | G03G 9/09 |

OTHER PUBLICATIONS

PCT International Search Report and Written Opinion of the International Searching Authority, International Application No. PCT/JP2013/056882, Mailing Date Jun. 18, 2013.

* cited by examiner

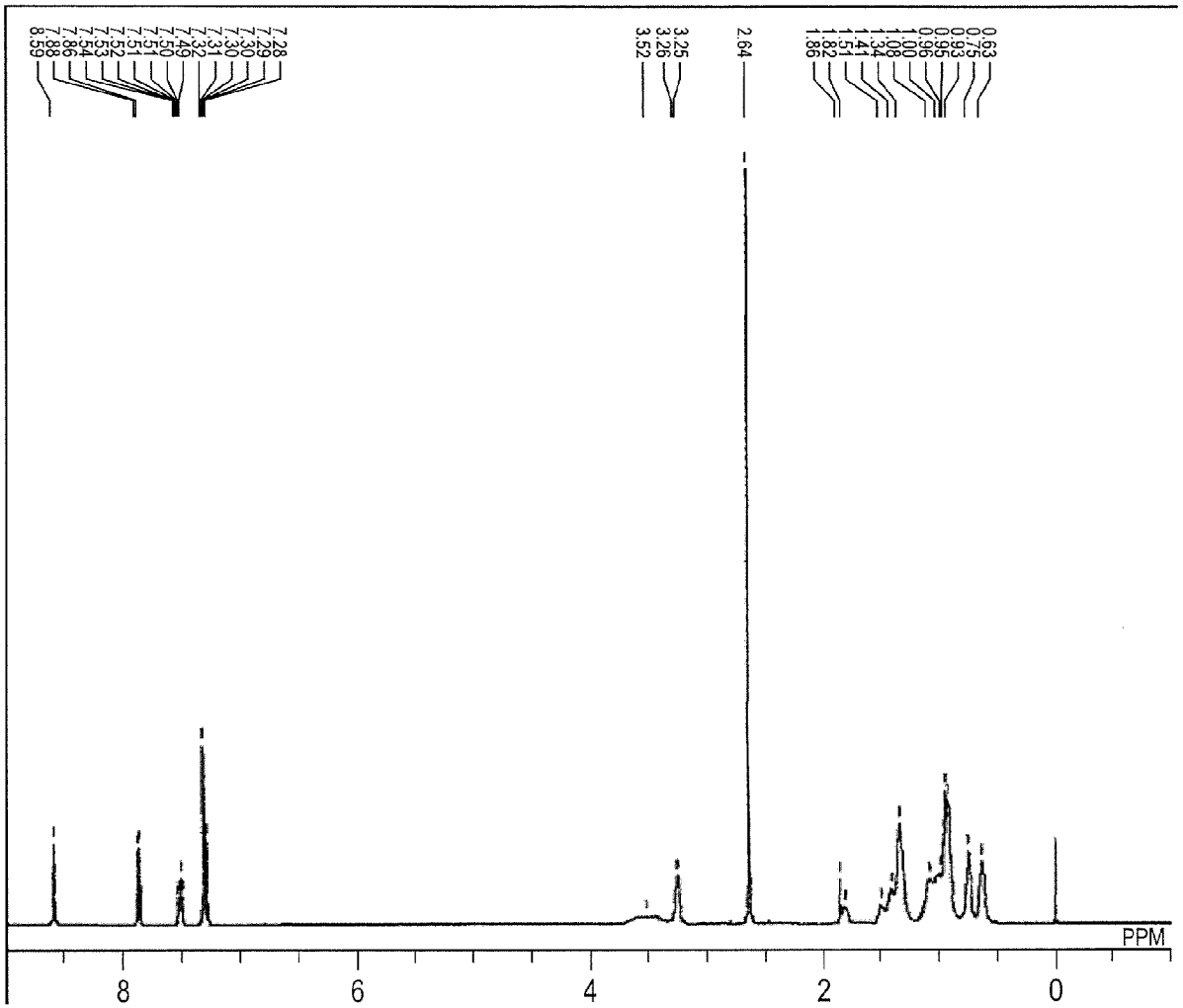
0.63
0.75
0.93
0.95
0.96
1.00
1.08
1.34
1.41
1.51
1.82
1.86
2.64
3.25
3.26
3.52
7.28
7.29
7.30
7.30
7.31
7.32
7.49
7.50
7.51
7.51
7.52
7.53
7.54
7.86
7.88
8.59
PPM
0
2
4
6
8

YELLOW TONER AND PROCESS FOR PRODUCING THE YELLOW TONER

TECHNICAL FIELD

The present invention relates to a yellow toner to be used for a recording method, such as an electrophotography method, an electrostatic recording method, a magnetic recording method, and a toner jet method, and to a process for producing the yellow toner.

BACKGROUND ART

Color imaging has been recently gaining in popularity and a demand for high image quality has been growing. In a digital full color copying machine or printer, a color image original is subjected to color separation by means of respective color filters of blue, green, and red, and then a latent image corresponding to the original image is developed using respective color developers of yellow, magenta, cyan, and black. Consequently, the image quality is strongly influenced by coloring power of colorants in the respective color developers.

It is important to reproduce Japan Color in the printing industry or approximate the Adobe RGB used in an RGB workflow. To secure such a color space, improvement of the dispersibility of a pigment, or use of a dye with a broad color gamut is effectual.

As a typical example of yellow pigments a pigment with an isoindoline skeleton such as C. I. pigment yellow 185, which has high clarity and coloring power and is superior in weather resistance, can be named. Some applications of the C. I. pigment yellow 185 to a toner have been known (See Patent Literatures 1 to 3).

CITATION LIST

Patent Literature

PTL 1: Japanese Patent Application Laid-Open No. H06-118715

PTL 2: Japanese Patent Application Laid-Open No. H06-250439

PTL 3: Japanese Patent Application Laid-Open No. 2005-106932

SUMMARY OF INVENTION

Technical Problem

It is known that C. I. pigment yellow 185 can hardly be dispersed sufficiently as a colorant in a binder resin, because of self-aggregation tendency due to the innate nature of the pigment. As a result, although the pigment has good weather resistance, a technology, which can exert fully the intrinsic performance of the pigment, has not yet been established in terms of clarity or saturation.

A large problem has also been that the particle size distribution of a toner with respect to a desired particle diameter becomes broad at a granulation step in producing the toner and coarse powder or fine powder is inevitably generated.

As a result, deterioration of an image, such as deterioration of the sharpness of a fine line in an image, development line marks, and image fogging due to adhesion of a toner to a non-image area, may take place. Further, various other drawbacks, such as toner spent onto a carrier, toner filming onto a drum, and fixing roller staining, can appear.

Meanwhile, for securing the color space, it is conceivable to use a dye with a broad color gamut in addition to improvement of the pigment dispersibility, there still remains a problem to be solved which is that the light resistance of a dye is low compared to a pigment.

Solution to Problem

The problems can be solved according to the invention described below.

Namely, the present invention provides a yellow toner comprising toner particles which contain at least a binder resin, a wax, and a colorant, wherein the colorant comprises C. I. pigment yellow 185 and a compound represented by the general formula (1), and a process for producing the same.

General formula (1)

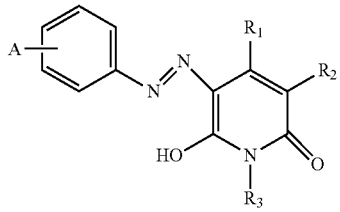

wherein,

A represents —$SO_2N(R_4)R_5$ or —$CON(R_4)R_5$, $R_4$ represents a hydrogen atom or an alkyl group, and $R_5$ represents an alkyl group, $R_1$ represents an alkyl group, an aryl group, or an amino group, $R_3$ represents a hydrogen atom, an alkyl group, an aryl group, or an aralkyl group, and $R_2$ represents (i) a hydrogen atom, a cyano group, or a carbamoyl group when $R_3$ represents a hydrogen atom, and (ii) a hydrogen atom, a cyano group, a carboxylic acid group, a carboxylate ester group, a carboxylic acid amide group, or a carbamoyl group when $R_3$ represents an alkyl group, an aryl group, or an aralkyl group.

Advantageous Effects of Invention

According to the present invention, by incorporating C. I. pigment yellow 185 and a compound represented by the general formula (1) as colorants, a yellow toner, which is superior in dispersibility of the C. I. pigment yellow 185, has a high color development property, and also is superior in light resistance, can be provided.

In a production step for a yellow toner, a compound represented by the general formula (1) suppresses aggregation of the C. I. pigment yellow 185 and exhibits activity of disintegrating a coarse particle, and consequently a process for producing a yellow toner superior in a granulation property can be provided.

Further features of the present invention will become apparent from the following description of exemplary embodiments with reference to the attached drawing.

BRIEF DESCRIPTION OF DRAWINGS

FIG. 1 is a diagram illustrating a $^1H$ NMR spectrum at 400 MHz in DMSO-$d_6$ at room temperature, of the compound (5) according to the general formula (1) of the present invention.

DESCRIPTION OF EMBODIMENTS

The present invention will be described in more detail in reference to embodiments.

The inventors studied intensively to solve the afore-described problem of the conventional art to find finally that a yellow toner having a toner particle containing at least a binder resin, a wax, and a colorant, the yellow toner being superior in dispersibility of C. I. pigment yellow 185, having a high color development property, and also being superior in light resistance, can be provided by incorporating C. I. pigment yellow 185 and a compound represented by the general formula (1) as the colorant, thereby completing the present invention.

General formula (1)

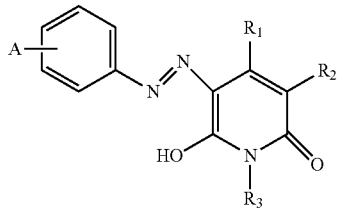

wherein,

A represents —$SO_2N(R_4)R_5$ or —$CON(R_4)R_5$, $R_4$ represents a hydrogen atom or an alkyl group, and $R_5$ represents an alkyl group, $R_1$ represents an alkyl group, an aryl group, or an amino group, $R_3$ represents a hydrogen atom, an alkyl group, an aryl group, or an aralkyl group, and $R_2$ represents (i) a hydrogen atom, a cyano group, or a carbamoyl group when $R_3$ represents a hydrogen atom, and (ii) a hydrogen atom, a cyano group, a carboxylic acid group, a carboxylate ester group, a carboxylic acid amide group, or a carbamoyl group when $R_3$ represents an alkyl group, an aryl group, or an aralkyl group.

There is no particular restriction on an alkyl group for $R_1$ in the general formula (1), and examples thereof include a C1 to C20 straight-chain, or branched alkyl group. Among others, from a standpoint of improved dispersibility of C. I. pigment yellow 185, a C1 to C12 straight-chain, or branched alkyl group is preferable, a C1 to C10 straight-chain, or branched alkyl group is more preferable, and a methyl group is further preferable.

There is no particular restriction on an aryl group for $R_1$ in the general formula (1), and examples thereof include a monocyclic or a polycyclic aryl group with a 6 to 14-membered ring, such as a phenyl group and a naphthyl group. Among others, a phenyl group is preferable.

There is no particular restriction on a carboxylate ester group for $R_2$ in the general formula (1), and examples thereof include a methyl carboxylate ester group, an ethyl carboxylate ester group, a propyl carboxylate ester group, and a butyl carboxylate ester group.

There is no particular restriction on a carboxylic acid amide group for $R_2$ in the general formula (1), and examples thereof include a mono-substituted amide group, such as a carbamoyl group, a carboxylic acid methylamide group, a carboxylic acid butylamide group, a carboxylic acid hexylamide group, and a carboxylic acid phenylamide group; and a di-substituted amide group, such as a carboxylic acid dimethylamide group, a carboxylic acid diphenylamide group, and a carboxylic acid methylpropylamide group.

Especially preferable is a cyano group for $R_2$ because of good dispersibility of C. I. pigment yellow 185.

In the general formula (1), $R_3$ represents a hydrogen atom, an alkyl group, an aryl group, or an aralkyl group. Among others, $R_3$ is preferably a hydrogen atom or an alkyl group.

In the general formula (1), (i) when $R_3$ is a hydrogen atom, $R_2$ represents a hydrogen atom, a cyano group, or a carbamoyl group, and (ii) when $R_3$ is an alkyl group, an aryl group, or an aralkyl group, $R_2$ represents a hydrogen atom, a cyano group, a carboxylic acid group, a carboxylate ester group, a carboxylic acid amide group, or a carbamoyl group.

There is no particular restriction on an alkyl group for $R_3$ in the general formula (1), and examples thereof include a C1 to C20 straight-chain, or branched alkyl group. Among others, a C1 to C12 straight-chain, or branched alkyl group is preferable.

There is no particular restriction on an aryl group for $R_3$ in the general formula (1), and examples thereof include a monocyclic or a polycyclic aryl group with a 6 to 14-membered ring, such as a phenyl group and a naphthyl group. Among others, a phenyl group is preferable.

There is no particular restriction on an aralkyl group for $R_3$ in the general formula (1), and examples thereof include a benzyl group and a phenethyl group.

It is especially preferable if $R_2$ is a cyano group or a carboxylic acid amide group and $R_3$ is a C2 to C12 alkyl group, because of good dispersibility of C. I. pigment yellow 185.

In the general formula (1), A represents —$SO_2N(R_4)R_5$ or —$CON(R_4)R_5$, $R_4$ represents a hydrogen atom or an alkyl group, and $R_5$ represents an alkyl group. Among others, —$CON(R_4)R_5$ is preferable, and more preferably $R_4$ and $R_5$ have the same structure.

There is no particular restriction on an alkyl group for $R_4$ and $R_5$ in the general formula (1), and examples thereof include a C1 to C20 straight-chain, or branched alkyl group. Among others, from a standpoint of improved dispersibility of C. I. pigment yellow 185, a C4 to C12 straight-chain, or branched alkyl group is preferable, a C6 to C10 straight-chain, or branched alkyl group is more preferable, and a branched ethylhexyl group is further preferable.

A is preferably —$CON(R_4)R_5$.

A compound represented by the general formula (1) according to the present invention can be synthesized in reference to a known method as disclosed, for example, in WO08/114,886.

Specific examples of a preferable compound represented by the general formula (1) of the present invention are listed below as compounds (1) to (26), provided that the former is not limited to the latter. Therein, Et represents an ethyl group, and n-Bu represents a n-butyl group.

Although the general formula (1) shows an azo-form, a compound represented by the general formula (1) is an azo-hydrazo-tautomer and therefore a hydrazo-form is also within the scope of the claims of the present invention.

Compound 1

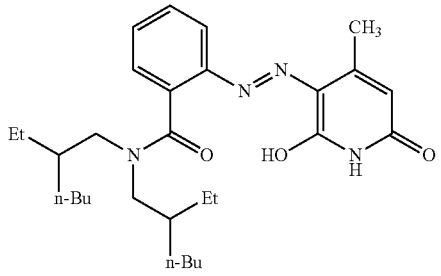

-continued
Compound 2
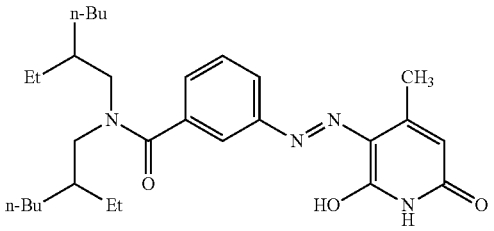
Compound 3
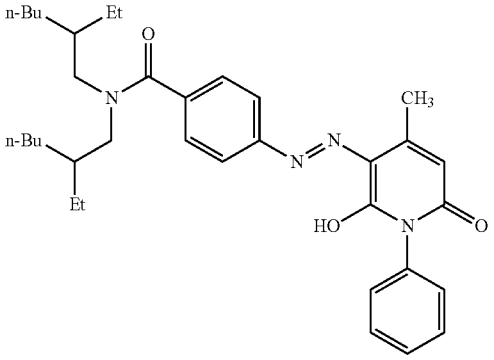
Compound 4
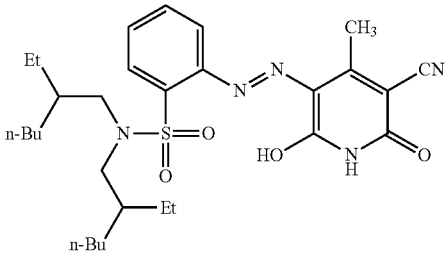
Compound 5
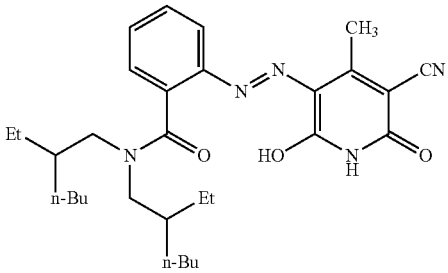
Compound 6
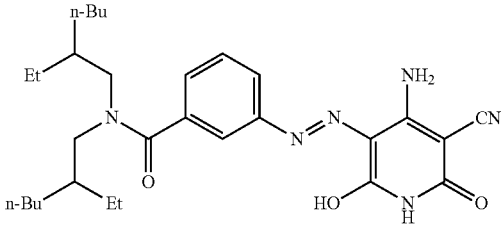
-continued
Compound 7
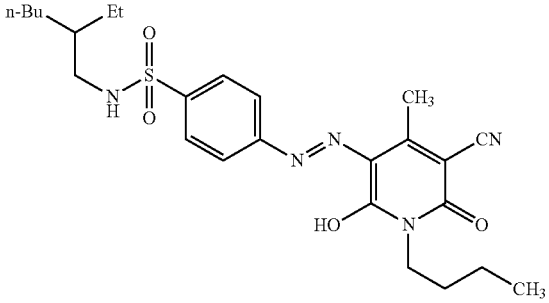
Compound 8
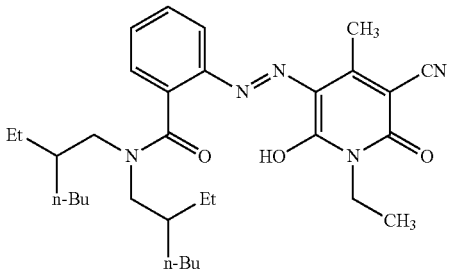
Compound 9
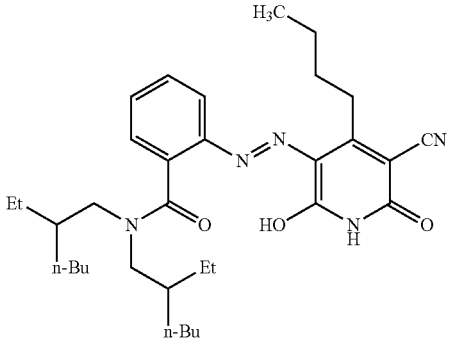
Compound 10
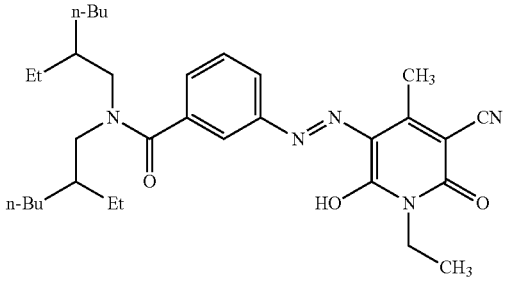

-continued
Compound 11
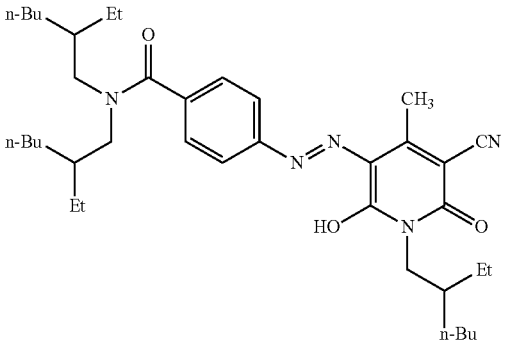
Compound 12
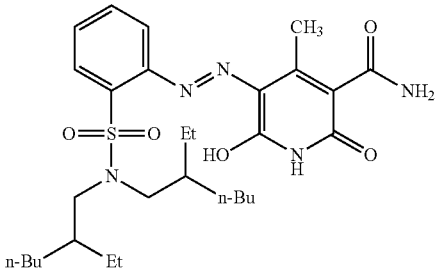
Compound 13
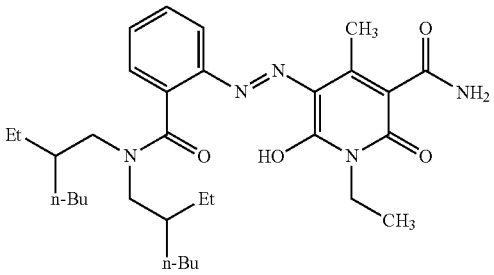
Compound 14
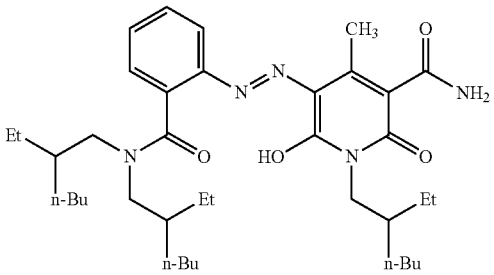
Compound 15
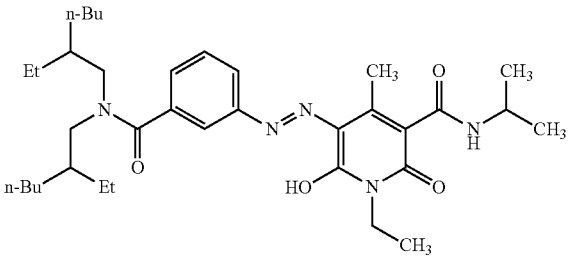
-continued
Compound 16
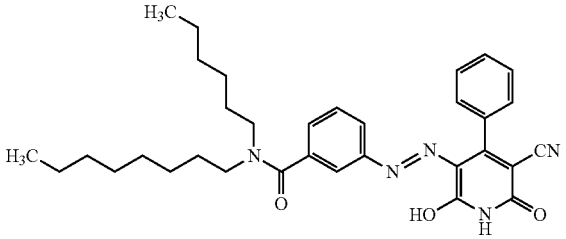
Compound 17
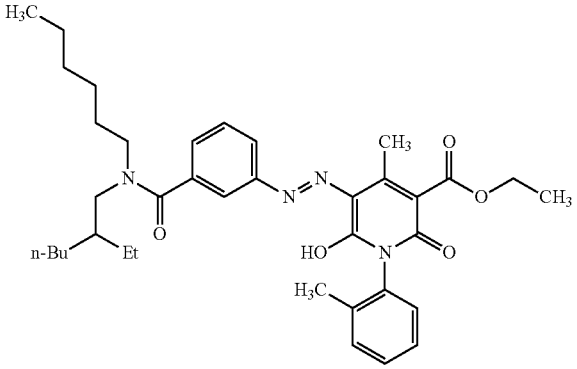
Compound 18
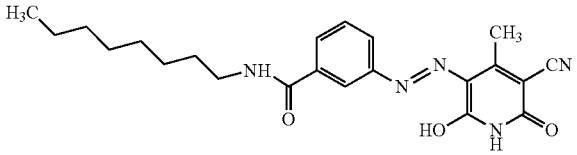
Compound (19)
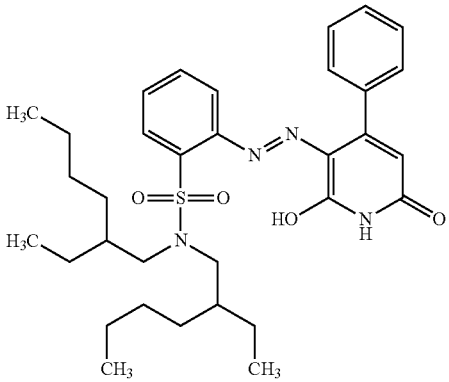
Compound (20)
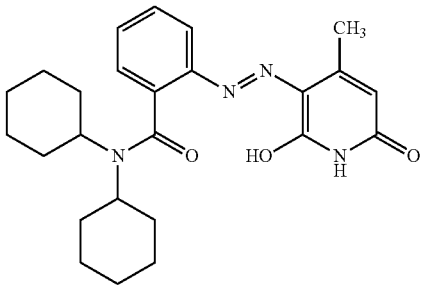

-continued

Compound (21)

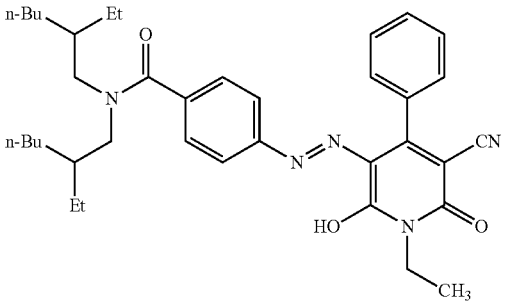

Compound (22)

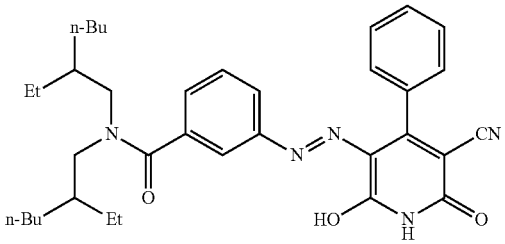

Compound (23)

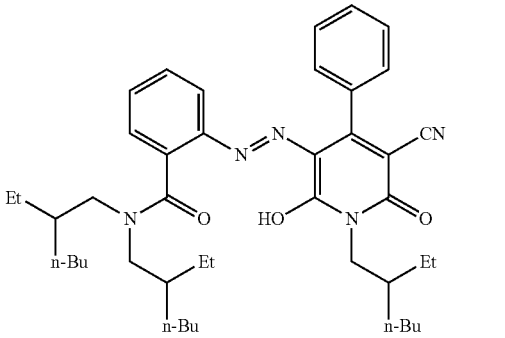

Compound (24)

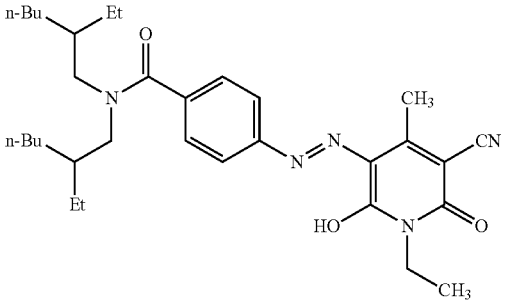

Compound (25)

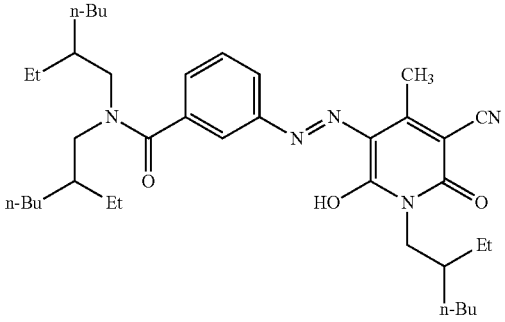

-continued

Compound (26)

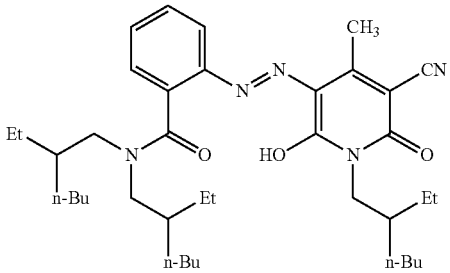

Among the above-listed compounds, compounds (5), (8), (10), (11), (15), (16), (21), (22), (23), (24), (25), and (26) are preferable, and compounds (8), (10), (11), (23), (24), (25), and (26) are more preferable.

A compound represented by the general formula (1) to be used in the present invention may be used singly or in combination with one or more known yellow dyes, depending on a production unit for each toner, and for adjusting the color tone, etc.

<Binder Resin>

There is no particular restriction on a binder resin to be used in the present invention and examples thereof include a thermoplastic resin.

Specific examples include a homopolymer or a copolymer of styrenes (a styrenic resin), such as styrene, p-chlorostyrene, and α-methylstyrene; a homopolymer or a copolymer of esters having a vinyl group (a vinyl resin), such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; a homopolymer or a copolymer of vinyl nitriles (a vinyl resin), such as acrylonitrile and methacrylonitrile; a homopolymer or a copolymer of vinyl ethers (a vinyl resin), such as vinyl ethyl ether and vinyl isobutyl ether; a homopolymer or a copolymer of vinyl methyl ketone, vinyl ethyl ketone, or isopropenyl ketone (a vinyl resin); a homopolymer or a copolymer of olefins (an olefinic resin), such as ethylene, propylene, butadiene, and isoprene; a non-vinyl condensation resin, such as an epoxy resin, a polyester resin, a polyurethane resin, a polyamide resin, a cellulosic resin, and a polyether resin; and a graft polymer of the non-vinyl condensation resin with a vinyl monomer. The resins may be used singly, or in combinations of two or more thereof.

A polyester resin is synthesized from an acid-derived component (dicarboxylic acid) and an alcohol-derived component (diol), while for the purpose of the present invention, "an acid-derived component" refers to a moiety, which was an acid component before the synthesis of a polyester resin, and "an alcohol-derived component" refers to a moiety, which was an alcohol component before the synthesis of a polyester resin.

There is no particular restriction on an acid-derived component according to the present invention, and examples thereof include an aliphatic dicarboxylic acid-derived component, a dicarboxylic acid-derived component with a double bond, and a dicarboxylic acid-derived component with a sulfonic acid group. Specific examples thereof include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and a lower alkyl ester or an acid anhydride thereof. Especially, an aliphatic dicarboxylic acid-derived component is desirable, and it is further preferable if the aliphatic moiety of an aliphatic dicarboxylic acid is a saturated carboxylic acid.

There is no particular restriction on an alcohol-derived component, but an aliphatic diol is desirable. Examples include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol.

In the present invention, a crosslinking agent may be used when a binder resin is synthesized in order to increase the mechanical strength of a toner particle and to regulate the molecular weight of a toner molecule.

There is no particular restriction on a crosslinking agent to be used for a toner according to the present invention, and examples of a bifunctional crosslinking agent include divinyl benzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentylglycol diacrylate, diethylene glycol diacrylate, triethylene glycol diacrylate, tetraethylene glycol diacrylate, respective diacrylates of polyethylene glycol #200, #400, and #600, dipropylene glycol diacrylate, polypropylene glycol diacrylate, polyester-type diacrylate, ethylene glycol dimethacrylate, 1,3-butylene glycol dimethacrylate, 1,4-butanediol dimethacrylate, 1,5-pentanediol dimethacrylate, 1,6-hexanediol dimethacrylate, neopentylglycol dimethacrylate, diethylene glycol dimethacrylate, triethylene glycol dimethacrylate, tetraethylene glycol dimethacrylate, respective dimethacrylates of polyethylene glycol #200, #400, and #600, dipropylene glycol dimethacrylate, polypropylene glycol dimethacrylate, and polyester-type dimethacrylate.

There is no particular restriction on a polyfunctional crosslinking agent, and examples thereof include pentaerythritol triacrylate, trimethylolethane triacrylate, trimethylolpropane triacrylate, tetramethylolmethane tetraacrylate, an oligoester acrylate and a methacrylate thereof, 2,2-bis(4-methacryloxyphenyl)propane, diallyl phthalate, triallyl cyanurate, triallyl isocyanurate, and triallyl trimellitate.

The crosslinking agent is used preferably in an amount of 0.05 to 10 parts by mass, more preferably 0.1 to 5 parts by mass with respect to 100 parts by mass of the monomer.

Next, a toner according to the present invention will be described.

Examples of a process for producing toner particles constituting a toner according to the present invention includes a grinding process, a suspension polymerization process, a suspension granulation process, an emulsion polymerization process, and an emulsion aggregation process. Among others, a suspension polymerization process, an emulsion aggregation process, and a grinding process are preferable, and a suspension polymerization process and an emulsion aggregation process are more preferable. A production process in which particles are formed in an aqueous medium is preferable. The toner of the present invention is also used in a developer used in a liquid development process (hereinafter referred to as "a liquid developer").

<Concerning Pigment Dispersion Product>

For using a toner according to the present invention, a step for dispersing a pigment to produce a pigment dispersion product (also called as "a masterbatch") is required.

The pigment dispersion product can be obtained by a dispersing treatment of at least C. I. pigment yellow 185 together with a compound represented by the general formula (1) in a dispersion medium.

C. I. pigment yellow 185 and the compound represented by the general formula (1) according to the present invention can be dispersed by a known dispersing process. The dispersion can be conducted for example as follows. C. I. pigment yellow 185 and a compound represented by the general formula (1), as well as, according to need, a resin are dissolved in a dispersion medium, and the resulting medium is stirred. Then a mechanical shear force is applied by a disperser, so that pigments can be finely dispersed as stable homogeneous fine particles.

Alternatively, a resin is dissolved in a dispersion medium, then C. I. pigment yellow 185 is suspended therein, and a compound represented by the general formula (1) is added gradually with stirring to mix up thoroughly with the dispersion medium. Then a mechanical shear force is applied by a disperser, so that pigments can be finely dispersed as stable homogeneous fine particles.

In either case, it is important to apply a mechanical shear force by a disperser simultaneously to C. I. pigment yellow 185 and a compound represented by the general formula (1).

There is no particular restriction on a disperser used in the present invention, and preferable examples include a media-type disperser, such as a rotational shear homogenizer, a ball mill, a sand mill, and Attritor, and a high pressure collision type disperser.

The amount of C. I. pigment yellow 185 in a pigment dispersion product according to the present invention is 1.0 to 30.0 parts by mass, preferably 2.0 to 20.0 parts by mass, and more preferably 3.0 to 15.0 parts by mass with respect to 100 parts by mass of a dispersion medium. Within the range, good coloring power can be attained.

A compound represented by the general formula (1) is used preferably in an amount of 10 to 100 parts by mass, especially 15 to 80 parts by mass with respect to 100 parts by mass of C. I. pigment yellow 185. Within the range, good dispersibility and coloring power can be attained, while deterioration by light of a compound represented by the general formula (1) can be suppressed.

The pigment dispersion product may be dispersed in water or an organic solvent depending on an intended use thereof.

There is no particular restriction on a disperser used in the present invention, and preferable examples include a media-type disperser, such as a rotational shear homogenizer, a ball mill, a sand mill, and Attritor, and a high pressure collision type disperser.

As an organic solvent used in the present invention, a polymerizable monomer is preferably used. Such a polymerizable monomer is a monomer polymerizable by addition or polymerizable by condensation, and preferably is a monomer polymerizable by addition. Specific examples include a styrenic monomer, such as styrene, o-methylstyrene, m-methylstyrene, p-methylstyrene, o-ethylstyrene, m-ethylstyrene, and p-ethylstyrene; an acrylate monomer, such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and acrylic acid amide; a methacrylate monomer, such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, and methacrylic acid amide; an olefinic monomer, such as ethylene, propylene, butylene, butadiene, isoprene, isobutylene, and cyclohexene; halogenated vinyls, such as vinyl chloride, vinylidene chloride, vinyl bromide, and vinyl iodide; vinyl esters, such as vinyl acetate, vinyl propionate, and vinyl benzoate; vinyl ethers such as vinyl methyl ether, vinyl ethyl ether, and vinyl isobutyl ether; and a vinyl ketone compound, such as vinyl methyl ketone, vinyl hexyl ketone, and methyl isopropenyl ketone. Depending on the intended use, these may be used singly or in combinations of two or more thereof. When a pigment dispersion product according to the present invention is used for a polymerized toner application, among the above-listed polymerizable monomers, preferably styrene or a styrenic monomer is used singly or in a mixture with another polymerizable monomer. From a standpoint of easy handling, styrene is preferable.

To the pigment dispersion product a resin may be added additionally. A resin usable for a pigment dispersion product is selected depending on an intended use, and there is no particular restriction thereon. Specific examples include a polystyrene resin, a styrene copolymer, a polyacrylic resin, a polymethacrylic resin, a polyacrylic ester resin, a polymethacrylic ester resin, an acrylic copolymer, a methacrylic copolymer, a polyester resin, a polyvinyl ether resin, a polyvinyl methyl ether resin, a polyvinyl alcohol resin, and a polyvinyl butyral resin. The resins may be used singly or in a mixture of two or more thereof.

<Concerning Materials Constituting Toner>

By using the pigment dispersion product as a colorant for a toner containing toner base particles, which contain at least a binder resin, a colorant, a wax, etc., increase of the dispersion viscosity in a dispersion medium can be suppressed, so that handling in a production step for a toner becomes easy and the dispersibility of the colorant remains good, and therefore a yellow toner having high coloring power as well as a process for producing the yellow toner can be provided.

There is no particular restriction on a wax usable in the present invention, and examples thereof include a petroleum wax, such as paraffin wax, a microcrystalline wax, and petrolatum, and a derivative thereof, a montan wax and a derivative thereof, a hydrocarbon wax by a Fischer-Tropsch process and a derivative thereof, a polyolefin wax as represented by polyethylene and a derivative thereof, a natural wax, such as carnauba wax and candelilla wax, and a derivative thereof, wherein a derivative includes an oxide, and a block copolymer or a graft modified polymer with a vinyl monomer. Examples further include an alcohol such as a higher aliphatic alcohol, a fatty acid such as stearic acid and palmitic acid, and a compound thereof, an acid amide, an ester, a ketone, a hydrogenated castor oil and a derivative thereof, a vegetable wax, and an animal wax. The above may be used singly or in combination thereof.

The total amount of a wax added, expressed as a content with respect to 100 parts by mass of a binder resin, is preferably in the range of 2.5 to 15.0 parts by mass, and more preferably in the range of 3.0 to 10.0 parts by mass. If the amount of a wax added is less than 2.5 parts by mass, oilless fusing becomes difficult, and if the amount exceeds 15.0 parts by mass, the amount of the wax in a toner particle is excessive and possible existence at a high concentration of such a surplus wax at toner particle surfaces may unfavorably impede a desired electrification property.

For a toner according to the present invention, a charge control agent may be mixed, according to need, with toner base particles and used. By doing so, the triboelectric charge amount can be controlled optimally according to a development system.

As a charge control agent, a known agent can be used, and a charge control agent, which can offer particularly high charging speed and maintain stably a constant electric charge amount, is preferable. Further, if a toner is produced by a direct polymerization process, a charge control agent with low polymerization inhibitory property and substantially without soluble matter in an aqueous dispersing medium is especially preferable.

Examples of a charge control agent, which controls a toner to negatively chargeable, include a polymer or a copolymer having a sulfonic acid group, a sulfonic acid base or a sulfonic acid ester group, a salicylic acid derivative and a metal complex thereof, a monoazometallic compound, an acetylacetone metallic compound, an aromatic oxycarboxylic acid, an aromatic mono- or poly-carboxylic acid and a metal salt thereof, an anhydride, esters, a phenol derivative such as bisphenol, a urea derivative, a metal-containing naphthoic acid compound, a boron compound, a quaternary ammonium salt, a calixarene, and a resin-type charge control agent.

Examples of a charge control agent, which controls a toner to positively chargeable, include nigrosin and a nigrosin derivative modified by a fatty acid metal salt, etc., a quaternary ammonium salt, such as a guanidine compound, an imidazole compound, a tributylbenzylammonium-1-hydroxy-4-naphthosulfonic acid salt, and tetrabutylammonium tetrafluoroborate, and an analog thereof, such as an onium salt like a phosphonium salt and a lake pigment therefrom, a triphenylmethane dye and a lake pigment therefrom (as a laking agent: phosphotungstic acid, phosphomolybdic acid, phosphotungstomolybdic acid, tannic acid, lauric acid, gallic acid, ferricyanide, ferrocyanide, etc.), a metal salt of a higher fatty acid, a diorganotin oxide, such as dibutyltin oxide, dioctyltin oxide, and dicyclohexyltin oxide, a diorganotin borate, such as dibutyltin borate, dioctyltin borate, and dicyclohexyltin borate, and a resin-type charge control agent. The above may be used singly or in combinations of two or more thereof.

An inorganic fine powder may be added externally as a flow agent to a toner according to the present invention. As an inorganic fine powder, a fine powder of silica, titanium oxide, alumina, and a double oxide of the above, as well as the above after surface treatment can be used.

<Process for Producing Toner by Suspension Polymerization Process>

Toner particles to be produced by a suspension polymerization process are produced, for example, as follows.

Firstly, a polymerizable monomer composition is prepared by mixing a colorant including the pigment dispersion product, a polymerizable monomer, a wax, a polymerization initiator, etc. Next, the polymerizable monomer composition is dispersed in an aqueous medium to form particles of the polymerizable monomer composition by granulation. Then a polymerizable monomer in the particles of the polymerizable monomer composition is polymerized in the aqueous medium to yield toner particles.

The polymerizable monomer composition in the above step is preferably prepared by dispersing the colorant in a first polymerizable monomer to obtain a dispersion, and mixing the dispersion with a second polymerizable monomer. Namely, a colorant including a pigment composition according to the present invention is dispersed thoroughly in a first polymerizable monomer, and then the same is mixed together with another toner material with a second polymerizable monomer, so that a pigment can be present in a toner particle in a better dispersed condition.

For a polymerization initiator used in the suspension polymerization process, a known polymerization initiator can be named, and examples include an azo compound, an organic peroxide, an inorganic peroxide, an organometallic compound, and a photopolymerization initiator. More specific examples include an azo polymerization initiator, such as 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl-2,2'-azobis(isobutyrate); an organic peroxide polymerization initiator, such as benzoyl peroxide, di-tert-butyl peroxide, tert-butyl peroxyisopropylmonocarbonate, tert-hexyl peroxybenzoate, and tert-butyl peroxybenzoate; an inorganic peroxide polymerization initiator, such as potassium persulfate, and ammonium persulfate; and a redox initiator, such as a hydrogen peroxide-ferrous iron system, a BPO-dimethylaniline system, and a cerium (IV) salt-alcohol system. Examples of a photopolymerization initiator include an acetophenone system, a benzoin ether system, and a ketal system. The above may be used singly or in combinations of two or more thereof.

The concentration of the polymerization initiator is preferably in the range of 0.1 to 20 parts by mass, and more preferably in the range of 0.1 to 10 parts by mass with respect to 100 parts by mass of the polymerizable monomer. A type of the polymerization initiator may be slightly different depending on a polymerization process, and used singly or in a mixture in reference to the 10 hour half-life temperature.

An aqueous medium used in the suspension polymerization process contains preferably a dispersion stabilizing agent. As the dispersion stabilizing agent, a known inorganic or organic dispersion stabilizing agent can be used. Examples of an inorganic dispersion stabilizing agent include calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of an organic dispersion stabilizing agent include polyvinyl alcohol, gelatin, methylcellulose, methyl hydroxypropylcellulose, ethylcellulose, sodium salt of carboxymethylcellulose, and starch. Further, a nonionic, anionic, and cationic surfactant can be also used. Examples thereof include sodium dodecyl sulfate, sodium tetradecyl sulfate, sodium pentadecyl sulfate, sodium octyl sulfate, sodium oleate, sodium laurate, potassium stearate, and calcium oleate.

Among the dispersion stabilizing agents, for the purpose of the present invention a poorly water soluble inorganic dispersion stabilizing agent, which is soluble in an acid, is preferably used. Further, for the purpose of the present invention, when an aqueous dispersing medium is prepared using a poorly water soluble inorganic dispersion stabilizing agent, the dispersion stabilizing agent is preferably used at a mixture ratio in the range of 0.2 to 2.0 parts by mass with respect to 100 parts by mass of the polymerizable monomer from a standpoint of the droplet stability of the polymerizable monomer composition in an aqueous medium. In the present invention, an aqueous medium is preferably prepared by using water in the range of 300 to 3,000 parts by mass with respect to 100 parts by mass of the polymerizable monomer composition.

When an aqueous medium, in which the poorly water soluble inorganic dispersion stabilizing agent is dispersed, is prepared in the present invention, a commercially available dispersion stabilizing agent may be dispersed as it is, however, the medium is preferably prepared by generating the poorly water soluble inorganic dispersion stabilizing agent in water under high speed agitation for obtaining a dispersion stabilizing agent particle having a uniform and fine particle diameter. If, for example, calcium phosphate is to be used as a dispersion stabilizing agent, a favorable dispersion stabilizing agent can be obtained by mixing an aqueous solution of sodium phosphate and an aqueous solution of calcium chloride under high speed agitation to form a fine particle of calcium phosphate.

<Process for Producing Toner by Suspension Granulation Process>

With respect to a toner particle according to the present invention, a suspension granulation process can also give favorable toner particles. Since there is no heating step in a production step of a suspension granulation process, compatibilization of a resin and a wax, which may take place when a low-melting wax is used, can be suppressed and decrease in the glass transition temperature of a toner caused by compatibilization can be prevented. Further, for a suspension granulation process the selection range of a toner material functioning as a binder resin can be wide, and a polyester resin, which is generally believed to be favorable for fixing, can be easily used as a main component. Consequently it is an advantageous production process, if a toner with a resin composition, to which a suspension polymerization process is not applicable, is to be produced.

Toner particles produced by the suspension granulation process are produced, for example, as follows.

Firstly, a solvent-containing composition is prepared by mixing a colorant including the pigment dispersion product, a binder resin, a wax, etc. in a solvent. Next, a toner particle suspension is yielded by dispersing the solvent-containing composition in an aqueous medium for forming particles of the solvent-containing composition by granulation. Then toner particles can be obtained by removing the solvent by heating the yielded suspension, or under a reduced pressure.

The solvent-containing composition in the above step is preferably prepared by dispersing the colorant in a first solvent to obtain a dispersion, and mixing the dispersion with a second solvent. Namely, a colorant including a pigment composition according to the present invention is dispersed thoroughly in a first solvent, and then the same is mixed together with another toner material with a second solvent, so that a pigment can be present in toner particles in a better dispersed condition.

Examples of a solvent usable in the suspension granulation process include hydrocarbons, such as toluene, xylene, and hexane; halogen-containing hydrocarbons, such as methylene chloride, chloroform, dichloroethane, trichloroethane, and carbon tetrachloride; alcohols, such as methanol, ethanol, butanol, and isopropyl alcohol; polyhydric alcohols, such as ethylene glycol, propylene glycol, diethylene glycol, and triethylene glycol; cellosolve family, such as methyl cellosolve, and ethyl cellosolve; ketones, such as acetone, methyl ethyl ketone, and methyl isobutyl ketone; ethers, such as benzyl alcohol ethyl ether, benzyl alcohol isopropyl ether, and tetrahydrofuran; and esters, such as methyl acetate, ethyl acetate, and butyl acetate. The above may be used singly or in a mixture of two or more thereof. For easy removal of a solvent in the toner particle suspension, a solvent which has a low boiling point and is capable of dissolving sufficiently the binder resin is preferably used among the above-listed solvents.

The usage of the solvent is preferably in the range of 50 to 5,000 parts by mass, and more preferably in the range of 120 to 1,000 parts by mass with respect to 100 parts by mass of the binder resin.

An aqueous medium to be used in the suspension granulation process preferably contains a dispersion stabilizing agent. As the dispersion stabilizing agent a known inorganic or organic dispersion stabilizing agent can be used. Examples of an inorganic dispersion stabilizing agent include calcium phosphate, calcium carbonate, aluminum hydroxide, calcium sulfate, and barium carbonate. Examples of an organic dispersion stabilizing agent include a water-soluble polymer, such as polyvinyl alcohol, methylcellulose, hydroxyethylcellulose, ethylcellulose, a sodium salt of carboxymethylcellulose, sodium polyacrylate, and sodium polymethacrylate; and surfactants including an anionic surfactant, such as sodium dodecylbenzenesulfonate, sodium octadecylsulfate, sodium oleate, sodium laurate, and potassium stearate; a cationic surfactant, such as laurylamine acetate, stearylamine acetate, and lauryltrimethylammonium chloride; a zwitterionic surfactant such as lauryldimethylamine oxide; and a nonionic surfactant, such as polyoxyethylene alkyl ether, polyoxyethylene alkyl phenyl ether, and polyoxyethylene alkyl amine.

The usage of the dispersing agent is preferably in the range of 0.01 to 20 parts by mass with respect to 100 parts by mass of the binder resin from a standpoint of the droplet stability of the solvent-containing composition in an aqueous medium.

A yellow toner according to the present invention has preferably the weight-average particle diameter D4 of 4.0 to 9.0 μm, and the ratio of the weight-average particle diameter D4 to the number-average particle diameter D1 (hereinafter also referred to as "weight-average particle diameter D4/number-average particle diameter D1" or "D4/D1") of 1.35 or less. More preferably the weight-average particle diameter D4 is 4.9 to 7.5 μm, and the weight-average particle diameter D4/number-average particle diameter D1 is 1.30 or less. If the percentage less than 4.0 μm with respect to the value of weight-average particle diameter D4 increases, when applied to an electrophotographic development system, stable electrification becomes hardly attainable, and in the case of multi-sheet continuous development operation (endurance operation) deterioration of an image, such as image fogging and development line marks, becomes apt to appear. Especially, if fine powders of 2.5 μm or less increase, such tendency becomes more significant. If the percentage more than 8.0 μm with respect to the value of weight-average particle diameter D4 increases, the reproducibility at a halftone region decreases significantly, and a resulted image becomes unfavorably rough in image texture. Especially, if coarse powders of 10.0 μm or more increase, such tendency becomes more significant. If the weight-average particle diameter D4/number-average particle diameter D1 exceeds 1.35, fogging and transferability get worse and fluctuation in the thickness of a fine line increases (hereinafter referred to as "decrease in sharpness").

An adjustment method of the weight-average particle diameter D4 and the number-average particle diameter D1 of a yellow toner according to the present invention varies depending on a process for producing a toner base particle. For example, in the case of a suspension polymerization process, the adjustment can be conducted by controlling the concentration of a dispersing agent used for the preparation of an aqueous dispersing medium, a stirring speed for a reaction, or a stirred reaction time.

<Process for Producing Toner by Grinding Process>

A toner by a grinding process may contain a binder resin and a colorant and if necessary, may further contain a magnetic material, a wax, a charge control agent, and other additives.

A toner by a grinding process according to the present invention can be produced by a production apparatus known to one skilled in the art, such as a blender, a heated kneading machine, and a classifier.

Firstly, the above materials are mixed sufficiently in a blender, such as a Henschel mixer and a ball mill. Next, the mixture is molten by a heated kneading machine, such as a roll, a kneader, and an extruder. Further, a wax or a magnetic material is dispersed in resins which have been blended and kneaded each other. After cooled and solidified, grinding and classification are carried out to yield a toner.

Examples of a binder resin used for a toner by a grinding process according to the present invention include a vinyl resin, a polyester resin, an epoxy resin, a polyurethane resin, a polyvinyl butyral resin, a terpene resin, a phenolic resin, an aliphatic or alicyclic hydrocarbon resin, and an aromatic petroleum resin, as well as a rosin or a modified rosin. Among others, a vinyl resin and a polyester resin are more preferable from viewpoints of electrification and fixing properties. Especially use of a polyester resin is preferable, because its effect on electrification and fixing properties is significant.

The resins may be used singly or in combinations of two or more thereof.

If a mixture of two or more resins is used, it is preferable to mix resins with different molecular weights in order to regulate the viscoelastic property of a toner.

With respect to a binder resin used for a toner by a grinding process according to the present invention, the glass transition temperature is preferably 45 to 80° C., more preferably 55 to 70° C., and the number average molecular weight (Mn) is preferably 2,500 to 50,000, and the weight-average molecular weight (Mw) is preferably 10,000 to 1,000,000.

There is no particular restriction on a polyester resin used in the present invention, the molar % ratio of alcohol component/acid component with respect to the entire components is especially preferably 45/55 to 55/45.

If the number of terminal groups of molecular chains in a polyester resin used in the present invention increases, the electrification property of a toner becomes more environment dependent. Therefore, the acid value is preferably 90 mgKOH/g or less, and more preferably 50 mgKOH/g or less. The hydroxyl value is preferably 50 mgKOH/g or less, and more preferably 30 mgKOH/g or less.

The glass transition temperature of a polyester resin used in the present invention is preferably 50 to 75° C., and more preferably 55 to 65° C.

The number-average molecular weight (Mn) is preferably 1,500 to 50,000, and more preferably 2,000 to 20,000.

The weight-average molecular weight (Mw) is preferably 6,000 to 100,000, and more preferably 10,000 to 90,000.

<Process for Producing Toner by Emulsion Aggregation Process>

Next, a process for producing a toner particle by emulsion aggregation as a production process will be described.

First, various dispersions according to the present invention are prepared. On that occasion, a wax dispersion, a resin particle dispersion, a colorant particle dispersion, or another toner component may be mixed together according to need.

Toner particles are obtained via a step for aggregating the mixture liquid thereof and forming aggregated particles (aggregation step), and a step for fusing the aggregated particles by heating (fusing step), a cleaning step, and a drying step.

Dispersions of respective particles may use a dispersing agent such as a surfactant. Specifically, a colorant particle dispersion is prepared by dispersing a colorant together with a surfactant in an aqueous medium. A colorant particle can be dispersed by a known method using favorably a media-type disperser, such as a rotational shear homogenizer, a ball mill, a sand mill, and Attritor, or a high pressure collision type disperser.

Examples of a surfactant according to the present invention include a water-soluble polymer, an inorganic compound, and an ionic or nonionic surfactant. Especially from a viewpoint of a dispersing property, an ionic surfactant, which has a good dispersing property, is preferable, and especially an anionic surfactant is used favorably.

From viewpoints of detergency and surfactant potency, the molecular weight of a surfactant is preferably 100 to 10,000 and more preferably 200 to 5,000.

Specific examples of the surfactant include a water-soluble polymer, such as polyvinyl alcohol, methylcellulose, carboxymethylcellulose, and sodium polyacrylate; surfactants including an anionic surfactant, such as sodium dodecylbenzenesulfonate, sodium octadecylsulfate, sodium oleate, sodium laurate, and potassium stearate; a cationic surfactant, such as laurylamine acetate and lauryltrimethylammonium chloride; a zwitterionic surfactant such as lauryldimethylamine oxide; and a nonionic surfactant, such as polyoxyethylene alkyl ether, polyoxyethylene alkyl phenyl ether, and polyoxyethylene alkyl amine; and an inorganic compound, such as tricalcium phosphate, aluminum hydroxide, calcium sulfate, calcium carbonate, and barium carbonate.

The above may be used singly or, according to need, in combinations of two or more thereof.

<Wax Dispersion>

A wax dispersion according to the present invention is prepared by dispersing a wax in an aqueous medium. The wax dispersion is prepared by a known process.

For the purpose of the present invention a wax means a material used for the purpose of preventing offsetting when a toner is fixed. Specific examples of a wax used frequently include a hydrocarbon wax, such as low molecular weight polyethylene, low molecular weight polypropylene, a microcrystalline wax, and a paraffin wax; an oxidized product of a hydrocarbon wax or a block copolymer thereof such as an oxidized polyethylene wax; a fatty acid ester wax, such as a carnauba wax, a Sasol wax, and a montanic acid ester wax; a partially or completely deoxidized fatty acid ester such as a deoxidized carnauba wax; a saturated straight-chain fatty acid, such as palmitic acid, stearic acid, and montanic acid; an unsaturated fatty acid, such as brassidic acid, eleostearic acid, and parinaric acid; a saturated alcohol, such as stearyl alcohol, aralkyl alcohol, behenyl alcohol, carnaubyl alcohol, ceryl alcohol, and melissyl alcohol; a polyhydric alcohol such as sorbitol; a fatty acid amide, such as linoleic acid amide, oleic acid amide, and lauric acid amide; a saturated fatty acid bisamide, such as methylenebisstearic acid amide, ethylenebiscapric acid amide, ethylenebislauric acid amide, and hexamethylenebisstearic acid amide; an unsaturated fatty acid amide, such as ethylenebisoleic acid amide, hexamethylenebisoleic acid amide, N,N'-dioleyladipic acid amide, and N,N'-dioleylsebacic acid amide; an aromatic bisamide, such as m-xylenebisstearic acid amide, and N,N'-distearylisophthalic acid amide; an aliphatic metal salt (generally called as a metallic soap), such as calcium stearate, calcium laurate, zinc stearate, and magnesium stearate; a wax prepared by grafting using a vinyl monomer, such as styrene and acrylic acid, onto an aliphatic hydrocarbon wax; a partial ester of a fatty acid and a polyhydric alcohol, such as behenic acid monoglyceride; a methyl ester compound having a hydroxyl group to be obtained by hydrogenation of a plant oil; and a C12 or higher long-chain alkyl alcohol or long-chain alkyl carboxylic acid. Among others, from a viewpoint of the balance between release properties and dispersibility in a resin, preferable examples include a hydrocarbon wax, a fatty acid ester wax, and a saturated alcohol. The above waxes may be used singly or, according to need, in combinations of two or more thereof.

The content of a wax in a toner according to the present invention is preferably 1 to 25 parts by mass, and more preferably 3 to 20 parts by mass with respect to 100 parts by mass of the toner particle. If the wax is less than 1 part by mass, the releasing effect of a wax decreases, while if the wax exceeds 25 parts by mass, the release property is satisfied, however, the developing property deteriorates so that adverse effects, such as sticking of a toner to a surface of a development sleeve or an electrostatic latent image carrier, tend to appear frequently.

The melting point of a wax according to the present invention is preferably 50° C. or more and 200° C. or less, and more preferably 55° C. or more and 150° C. or less. If a wax has the melting point less than 50° C., the anti-blocking property of a toner may decline, and if the melting point exceeds 200° C., the wax exuding property during fixing becomes poor and the release property in oilless fusing may be deteriorated.

For the purpose of the present invention a melting point means the temperature of the main endothermic peak of a differential scanning calorimetry (DSC) curve measured according to ASTM D3418-82. More specifically, the melting point of a wax is the temperature of the main endothermic peak of a DSC curve, which is obtained in the second temperature increase process in a temperature range of 30 to 200° C., wherein a differential scanning calorimeter (DSC822, by Mettler-Toledo K. K.) is used for a measurement temperature range of 30 to 200° C., with a temperature increase rate of 5° C./min in a normal temperature and humidity environment.

The amount of a wax according to the present invention added is preferably in the range of 2.5 to 15.0 parts by mass, and more preferably in the range of 3.0 to 10.0 parts by mass with respect to 100 parts by mass of a binder resin. If the amount of a wax added is less than 2.5 parts by mass, oilless fusing becomes difficult, and if the amount exceeds 15.0 parts by mass, the amount of the wax in a toner particle is excessive and possible existence at a high concentration of such a surplus wax at toner particle surfaces may unfavorably impede a desired electrification property.

<Resin Particle Dispersion>

A resin particle dispersion to be used in the present invention is prepared by dispersing resin particles in an aqueous medium.

For the purpose of the present invention an aqueous medium means a medium containing water as a main component. Specific examples of an aqueous medium include water itself, water with a pH adjustor added, and water with an organic solvent added.

There is no particular restriction on a resin constituting a resin particle included in the resin particle dispersion, insofar as it is a resin suitable for a toner having the following properties, however a thermoplastic binder having the glass transition temperature equal to or lower than the fixing temperature in an electrophotographic apparatus is preferable.

Specific examples thereof include a homopolymer of, or a copolymer obtained by combining two or more of: styrenes, such as styrene, p-chlorostyrene, and α-methylstyrene; a vinyl group monomer, such as methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate, 2-ethylhexyl methacrylate, acrylonitrile, and methacrylonitrile; a vinyl ether monomer, such as vinyl methyl ether and vinyl isobutyl ether; a vinyl ketone monomer, such as vinyl methyl ketone, vinyl ethyl ketone, and vinyl isopropenyl ketone; and a olefinic monomer, such as ethylene, propylene, and butadiene; as well as a mixture of the homopolymers and the copolymers, and further an epoxy resin, a polyester resin, a polyurethane resin, a polyamide resin, a cellulosic resin, a polyether resin or a non-vinyl condensation resin; or a mixture of the same with any of the vinyl resins, and a graft polymer obtained by polymerizing the vinyl monomer in the presence of the same. From viewpoints of a fixing property and an electrification property as a toner, especially a polystyrene resin and a polyester resin are used preferably. The above resins may be used singly or in combinations of two or more thereof.

A resin particle dispersion to be used in the present invention is prepared by dispersing a resin particle in an aqueous medium. The resin particle dispersion is prepared by a known process. In the case of a resin particle dispersion containing a resin particle with a vinyl monomer, especially a styrenic monomer, as a constituent, a resin particle dispersion can be prepared by conducting an emulsion polymerization of the monomer using a surfactant, etc.

In the case of a resin prepared by another process (e.g. a polyester resin), the resin is dispersed in water together with an ionic surfactant and a polymer electrolyte, by a disperser such as a homogenizer. Thereafter a solvent is evaporated off to yield a resin particle dispersion. Alternatively, a resin particle dispersion may be prepared by a process, in which a surfactant is added to a resin and the mixture is then emulsified and dispersed in water by a disperser such as a homogenizer, or by a phase inversion emulsification process.

The median diameter based on volume of a resin particle in a resin particle dispersion is preferably 0.005 to 1.0 μm, and more preferably 0.01 to 0.4 μm. If the median diameter is 1.0 μm or more, a toner particle with the weight-average particle diameter of 3.0 to 7.5 μm, which is appropriate for a toner particle, is hardly obtained.

The average particle diameter of a resin particle can be measured by, for example, a dynamic light scattering method (DLS), a laser scattering method, a centrifugal sedimentation method, a field-flow fractionation method, and an electrical sensing zone method. For the purpose of the present invention, an average particle diameter means, unless otherwise specified, a volume basis 50% cumulative particle diameter (D50) measured by a dynamic light scattering method (DLS)/Laser-Doppler method at 20° C. and a solid concentration of 0.01 mass-%, as described below.

<Colorant Particle Dispersion>

A colorant particle dispersion according to the present invention is prepared by dispersing a colorant together with a surfactant in an aqueous medium. Firstly, dispersions of pigment yellow 185 and a compound represented by the general formula (1) of the present invention are each prepared. A dispersion of a mixture of the pigment yellow 185 and the compound represented by the general formula (1) can be also prepared. Although colorant particles can be dispersed by a known process, for example, a media-type disperser, such as a rotational shear homogenizer, a ball mill, a sand mill, and Attritor, or a high pressure collision type disperser can be preferably used.

The content of a colorant is preferably 1 to 20 parts by mass with respect to 100 parts by mass of the resin. Below 1 part by mass, securement of an adequate toner concentration may become difficult, and above 20 parts by mass, a colorant not any more contained in toner particles tends to increase.

The amount of a surfactant used is with respect to 100 parts by mass of the colorant 0.01 to 10 parts by mass, preferably 0.1 to 5.0 parts by mass, and especially preferably 0.5 parts by mass to 3.0 parts by mass, because the surfactant can be removed easily from a toner particle. As a result, the amount of a surfactant remained in the yielded toner decreases, resulting in that the image concentration by the toner can be high and occurrence of fogging can be suppressed.

[Aggregation Step]

There is no particular restriction on a process for forming an aggregated particle, and, as a favorable example, a pH adjustor, an aggregating agent, a stabilizer, etc. may be added to the above mixture liquid, which is then mixed and subjected appropriately to heat, mechanical power (stirring), etc.

There is no particular restriction on a pH adjustor according to the present invention, and examples thereof include an alkali, such as ammonia and sodium hydroxide, and an acid, such as nitric acid and citric acid.

There is no particular restriction on an aggregating agent according to the present invention, and examples thereof include an inorganic metallic salt, such as sodium chloride, magnesium carbonate, magnesium chloride, magnesium nitrate, magnesium sulfate, calcium chloride, and aluminum sulfate; and a divalent or higher-valent metal complex.

As a stabilizer according to the present invention, mainly a surfactant is named.

There is no particular restriction on a surfactant, and examples thereof include a water-soluble polymer, such as polyvinyl alcohol, methylcellulose, carboxymethylcellulose, and sodium polyacrylate; surfactants including an anionic surfactant, such as sodium dodecylbenzenesulfonate, sodium octadecylsulfate, sodium oleate, sodium laurate, and potassium stearate; a cationic surfactant, such as laurylamine acetate and lauryltrimethylammonium chloride; a zwitterionic surfactant such as lauryldimethylamine oxide; and a nonionic surfactant, such as polyoxyethylene alkyl ether, polyoxyethylene alkyl phenyl ether, and polyoxyethylene alkyl amine; and an inorganic compound, such as tricalcium phosphate, aluminum hydroxide, calcium sulfate, calcium carbonate, and barium carbonate. The above may be used singly or, according to need, in combinations of two or more thereof.

Although there is no particular restriction on the average particle diameter of a formed aggregation particle, the average particle diameter may be regulated in general to be equivalent to the average particle diameter of an intended toner particle. The regulation can be easily performed, for example, by setting or changing appropriately the temperature during the addition/mixing of an aggregating agent or the condition for the stirred mixing. Further, the pH adjustor, the surfactant, etc. may be added appropriately to prevent sticking between toner particles.

[Fusing Step]

A toner particle is formed in a fusing step by heating the aggregated particles for fusion.

The heating temperature may be between the glass transition temperature (Tg) of a resin contained in an aggregated particle and the degradation temperature of the resin. For example, with stirring as in the aggregation step, progress of aggregation is stopped by adding a surfactant, adjusting the pH, etc., and the temperature is raised by heating to the glass transition temperature of the resin in the resin particle or higher to cause the fusion and coalescence of the aggregated particles.

The heating continues until the fusion has progressed adequately, and specifically for 10 min to 10 hours.

A step for forming a core-shell structure (adhesion step), in which a fine particle dispersion with dispersed fine particles is added and mixed with the aggregated particle so as to adhere the fine particles onto the aggregated particle, may be additionally included before or after the fusing step.

[Cleaning Step]

In the present invention, a toner particle is obtained by cleaning, filtrating, drying, etc. a toner particle obtained after the fusing step under appropriate conditions. In this case, in order to secure a sufficient electrification property and reliability as a toner, the toner particle is preferably cleaned thoroughly.

Although there is no restriction on a cleaning method, for example, a suspension containing a toner particle is filtered, the obtained filtrand is cleaned by distilled water with stirring, and the mixture is filtered again. From a viewpoint of the electrification property of a toner, cleaning is repeated until the electric conductivity of the filtrate decreases to 150 μS/cm or less. If the electric conductivity exceeds 150 μS/cm, the electrification property of the toner decreases, and, as a result, such drawbacks as fogging or decrease in image concentration will appear.

Further, an inorganic granule, such as silica, alumina, titania, and calcium carbonate, a resin particle, such as a vinyl resin, a polyester resin, and a silicone resin, may be added onto a surface of an obtained toner particle in a dry state while applying a shear force. The inorganic granule and the resin particle act as an external additive of a flow aid, a cleaning aid, etc.

[Drying Step]

For drying a known process, such as a ordinary vibrating fluid bed drying process, a spray drying process, a freeze-drying process, and a flash jet process, can be applied. The water content of a toner particle after drying is preferably 1.5 mass-% or less, and more preferably 1.0 mass-% or less.

For a toner according to the present invention, a charge control agent can be mixed according to need with toner base particles and used. By this means, the triboelectric charge amount can be controlled to an optimal value corresponding to a development system.

As a charge control agent, a known agent can be used, and especially a charge control agent, which can offer particularly high charging speed and maintain stably a constant charge amount, is preferable. Further, if a toner is produced by a direct polymerization process, a charge control agent with low polymerization inhibitory property and substantially without soluble matter in an aqueous dispersing medium is especially preferable.

Examples of a charge control agent, which controls a toner to negatively chargeable, include a polymer or a copolymer having a sulfonic acid group, a sulfonic acid base or sulfonic acid ester group, a salicylic acid derivative and a metal complex thereof, a monoazometallic compound, an acetylacetone metallic compound, an aromatic oxycarboxylic acid, an aromatic mono- or poly-carboxylic acid and a metal salt thereof, an anhydride, esters, a phenol derivative such as bisphenol, a urea derivative, a metal-containing naphthoic acid compound, a boron compound, a quaternary ammonium salt, a calixarene, and a resin-type charge control agent.

Examples of a charge control agent, which controls a toner to positively chargeable, include nigrosin and a nigrosin derivative modified by a fatty acid metal salt, etc., a quaternary ammonium salt, such as a guanidine compound, an imidazole compound, a tributylbenzylammonium-1-hydroxy-4-naphthosulfonic acid salt, and tetrabutylammonium tetrafluoroborate, and an analog thereof, such as an onium salt like a phosphonium salt and a lake pigment therefrom, a triphenylmethane dye and a lake pigment therefrom (as a laking agent: phosphotungstic acid, phosphomolybdic acid, phosphotungstomolybdic acid, tannic acid, lauric acid, gallic acid, ferricyanide, ferrocyanide, etc.), a metal salt of a higher fatty acid, a diorganotin oxide, such as dibutyltin oxide, dioctyltin oxide, and dicyclohexyltin oxide, a diorganotin borate, such as dibutyltin borate, dioctyltin borate, and dicyclohexyltin borate, and a resin-type charge control agent. The above may be used singly or in combinations of two or more thereof.

An inorganic fine powder may be added externally as a flow agent to a toner according to the present invention. As an inorganic fine powder, a fine powder of silica, titanium oxide, alumina, and a double oxide of the above, as well as the above after surface treatment can be used.

A toner according to the present invention has preferably the weight-average particle diameter D4 of 4.0 to 9.0 μm, and the ratio of the weight-average particle diameter D4 to the number-average particle diameter D1 (hereinafter also referred to as "weight-average particle diameter D4/number-average particle diameter D1" or "D4/D1") of 1.35 or less. More preferably the weight-average particle diameter D4 is 4.9 to 7.5 μm, and the weight-average particle diameter D4/number-average particle diameter D1 is 1.30 or less. If the percentage less than 4.0 μm with respect to the value of weight-average particle diameter D4 increases, when applied to an electrophotographic development system, stable electrification becomes hardly attainable, and in the case of multi-sheet continuous development operation (endurance operation) deterioration of an image, such as image fogging and development line marks, becomes apt to appear. Especially, if fine powders of 2.5 μm or less increase, such tendency becomes more significant. If the percentage more than 8.0 μm with respect to the value of weight-average particle diameter D4 increases, the reproducibility at a halftone region decreases significantly, and a resulted image becomes unfavorably rough in image texture. Especially, if coarse powders of 10.0 μm or more increase, such tendency becomes more significant. If the weight-average particle diameter D4/number-average particle diameter D1 exceeds 1.35, fogging and transferability get worse and fluctuation in the thickness of a fine line or the like increases (hereinafter referred to as "decrease in sharpness").

Preferably, the average circularity of a toner measured by a flow-type particle image analyzer for a toner according to the present invention is 0.930 to 0.995, and more preferably 0.960 to 0.990 from a standpoint that the transferability of a toner can be improved significantly.

A toner according to the present invention may be either a magnetic toner or a nonmagnetic toner. If used as a magnetic toner, a toner particle constituting a toner according to the present invention may be mixed with a magnetic material. Examples of such a magnetic material include an iron oxide, such as magnetite, maghemite, and ferrite, or an iron oxide containing another metal oxide, a metal, such as Fe, Co, and Ni, an alloy between the metal and a metal, such as Al, Co, Cu, Pb, Mg, Ni, Sn, Zn, Sb, Be, Bi, Cd, Ca, Mn, Se, Ti, W, and V, and a mixture thereof.

<Process for Producing Liquid Developer>

A process for producing a liquid developer will be described below.

Firstly, a liquid developer may be produced in such a manner that a toner having a binder resin and a colorant is dispersed or dissolved in an electrical insulating carrier liquid. At that time, an auxiliary agent, such as a charge control agent and a wax may be dispersed or dissolved in the liquid developer if necessary. Alternatively, the liquid developer may be prepared by a 2-stage process, by which a concentrated toner is firstly prepared and then the concentrate is diluted with an electrical insulating carrier liquid.

There is no particular restriction on a disperser used in the present invention, and preferable examples include a media-type disperser, such as a rotational shear homogenizer, a ball mill, a sand mill, and Attritor, and a high pressure collision type disperser.

To the above-described toner known colorants such as a pigment or a dye may be further added singly or in combinations of two or more thereof.

A wax and a colorant to be used in the present invention are the same as described above.

There is no particular restriction on a charge control agent used in the present invention, insofar as the charge control agent is used for a liquid developer for electrostatic charge image development. Examples thereof include cobalt naphthenate, copper naphthenate, copper oleate, cobalt oleate, zirconium octoate, cobalt octoate, sodium dodecylbenzene sulfonate, calcium dodecylbenzene sulfonate, soybean lecithin, and aluminum octoate.

Although there is no particular restriction on an electrical insulating carrier liquid used in the present invention, for example, an organic solvent with the electrical resistance as high as $10^9$ Ω·cm or more and the dielectric constant as low as 3 or less is used preferably. Specific and preferable examples thereof include an aliphatic hydrocarbon solvent, such as hexane, pentane, octane, nonane, decane, undecane, and dodecane, Isopar H, G, K, L, and M (by ExxonMobil Chemical Company), and Linealene Dimer A-20 and A-20H (by Idemitsu Kosan Co., Ltd.), which have the boiling point in a temperature range of 68 to 250° C. The above may be used singly or in combinations of two or more thereof to the extent that the viscosity of the system becomes not too high.

EXAMPLE

The present invention will be described below in more detail in reference to Examples and Comparative Examples, provided that the present invention be not limited to Examples. Expressions of "part(s)" and "%" in the description are based on mass, unless otherwise specified. The identification of a reaction product was conducted by a plurality of analysis methods using the apparatus described below.

[Production of Compounds According to General Formula (1)]

Compounds according to the general formula (1) of the present invention were produced by a process described below.

Production Example 1

Production Example of Compound (5)

In a nitrogen atmosphere 29 parts of thionyl chloride was dropped into 100 parts of chloroform containing 10 parts of o-nitrobenzoic acid, and then left reacting at 60° C. for 1 hour. After the end of the reaction and cooled to 10° C. or less, 9 parts of triethylamine and 15 parts of di(2-ethylhexyl)amine were dropped in series. After reaction with stirring at 80° C. for another 2 hours, the reaction was extracted with chloroform. After concentration under a reduced pressure, 18 parts of an intermediate (5-1) was obtained.

To 10 parts of the intermediate (5-1), 50 parts of ethanol and 18 parts of 20% aqueous solution of sodium sulfide were added and left reacting at 75° C. for 1 hour. After the end of the reaction, the reaction was extracted with chloroform, and the solution was concentrated under a reduced pressure to obtain 7.4 parts of an intermediate (5-2).

To 5.9 parts of the intermediate (5-2), 3.4 parts of concentrated hydrochloric acid and 59 parts of methanol were added and then cooled to 10° C. or less. Into the solution, a water (2.0 parts by mass) solution of 1.4 parts of sodium nitrite was gradually dropped so that the temperature should not rise to 10° C. or more, and left reacting for another 1 hour. Then 0.5 parts of sulfamic acid was added and stirred for 20 min to obtain a diazonium salt solution. Next a solution of 2.7 parts of 3-cyano-4-methyl-6-oxo-2-pyridone in 25 parts of N,N-dimethylformamide and 20 parts of methanol was cooled to 10° C. or less and the diazonium salt solution was dropped thereinto, while keeping the temperature at 10° C. or less.

A saturated aqueous solution of sodium carbonate was added for adjusting the pH between 5 and 6, and the solution was left reacting at 10° C. or less for 2 hours. After the end of the reaction and removal of the solvents under a reduced pressure, the reaction was purified by column chromatography to obtain 5.2 parts of compound (5).

The purity of the obtained compound (5) was examined using high performance liquid chromatography (HPLC) (LC2010A, by Shimadzu Corporation). Further, the structure was determined using a time-of-flight mass spectrometer (TOF-MS) (LC/MSD TOF, by Agilent Technologies, Inc.) and a nuclear magnetic resonance spectrometer (NMR) (ECA-400, by JEOL Ltd.).

[Analysis Results of Compound (5)]

<HPLC Results>

(Eluent=$CH_3OH$:$H_2O$=90:10, flow rate=1.0 mL/min, detection wavelength=254 nm) retention time=9.6 min, purity=99.5% by area

[1] $^1$H-NMR (400 MHz, $CDCl_3$, room temperature), δ [ppm]=8.59 (1H, s), 7.87 (1H, d), 7.54-7.49 (1H, m), 7.30 (2H, m), 3.52 (2H, s), 3.25 (2H, d), 2.64 (3H, s), 1.86-1.82 (1H, m), 1.51-0.63 (30H, m) (ref. FIG. 1)

[2] MALDI-TOF-MS mass spectroscopy: m/z=522.3458 $(M+H)^-$

<Production of Other Compounds>

Production Examples 2 to 18

Production of Compounds (1) to (4), and (6) to (18)

The compounds (1) to (4), and (6) to (18) were synthesized and identified similarly as in the production example 1.

Production Example 19

Production of Compound (19)

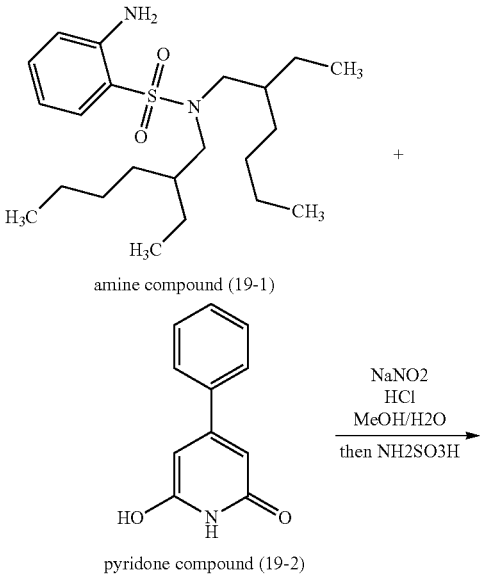

-continued

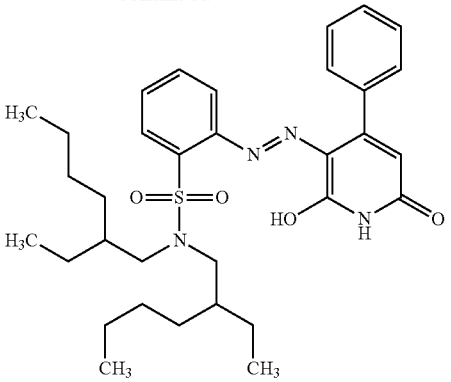

compound (19)

A solution of 3.00 g of the amine compound (19-1) in 10 mL of methanol was cooled to 5° C., into which 1.3 mL of 35% hydrochloric acid was dropped. Into the solution, a solution of 0.58 g of sodium nitrite in 3 mL of water was dropped, the solution was stirred for 1 hour, and then 0.09 g of amidosulfuric acid was added to degrade excessive sodium nitrite to obtain a diazotization solution. Separately, a solution of 1.42 g of the pyridone compound (19-2) in 10 mL of methanol was cooled to 5° C., into which the diazotization solution was dropped gradually so as to keep the temperature at 5° C. or less, followed by stirring between 0 and 5° C. for 1 hour. After the end of the reaction, an aqueous solution of sodium carbonate was dropped to neutralize the pH to 6, and a deposited solid was filtered and washed with water. The obtained solid was purified by column chromatography (eluent: chloroform/methanol), and further recrystallized from a heptane solution to obtain 3.0 g of the compound (19).

[Analysis Results of Compound (19)]

[1] $^1$H-NMR (400 MHz, $CDCl_3$, room temperature): δ [ppm]=0.76-0.85 (12H, m), 1.11-1.35 (16H, m), 1.55 (2H, br), 2.98-3.19 (4H, m), 6.31 (1H, s), 7.17 (1H, t, J=7.25 Hz), 7.42 (1H, t, J=7.25 Hz), 7.49 (6H, br), 7.79 (1H, d, J=7.63 Hz), 8.21 (1H, s), 14.81 (1H, s)

[2] MALDI-TOF-MS mass spectroscopy: m/z=593.318 $(M-H)^-$

Production Example 20

Production of Compound (20)

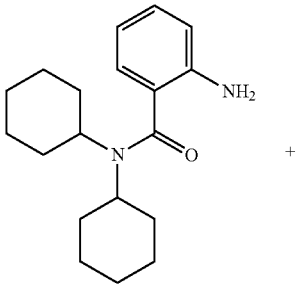

amine compound (20-1)

-continued

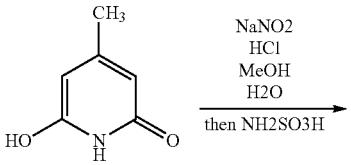

pyridone compound (20-2)

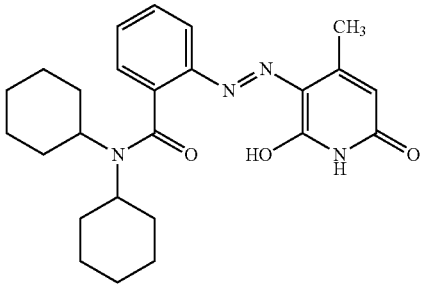

compound (20)

The compound (20) was obtained by the same operation as in Example 19, except that the amine compound and the pyridone compound in Example 19 were changed to the amine compound (20-1) and the pyridone compound (20-2), respectively.

[Analysis Results of Compound (20)]

[1] $^1$H-NMR (400 MHz, $CDCl_3$, room temperature): δ [ppm]=1.08-1.41 (5H, m), 1.59-1.98 (14H, m), 2.31 (3H, s), 2.58 (1H, br), 3.28 (2H, br), 6.09 (1H, s), 7.16 (2H, m), 7.42 (1H, t, J=16.78 Hz), 7.80 (1H, d, J=8.39 Hz), 8.03 (1H, s), 14.31 (1H, s)

[2] MALDI-TOF-MS mass spectroscopy: m/z=435.239 $(M-H)^-$

Production Example 21

Production of Compound (21)

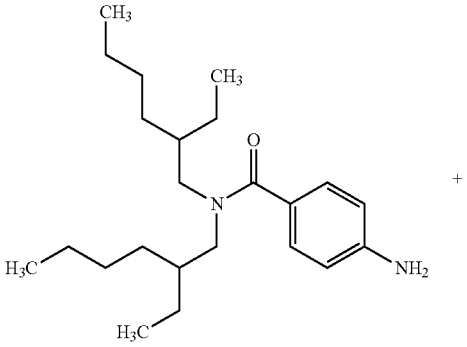

amine compound (21-1)

-continued

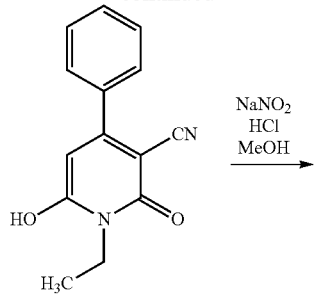

pyridone compound (21-2)

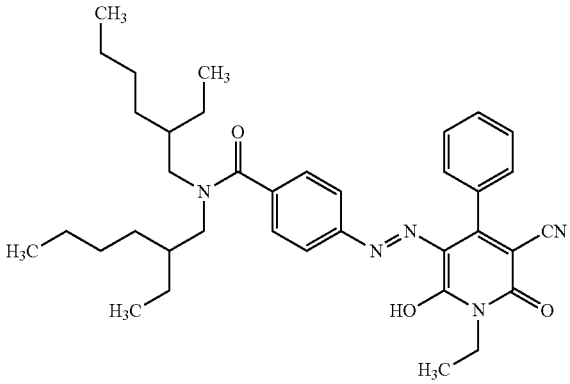

compound (21)

A solution of 1.8 g of the amine compound (21-1) in 50 mL of methanol was cooled to 5° C., into which 1.3 mL of 35% hydrochloric acid was dropped. Into the solution, a solution of 0.4 g of sodium nitrite in 8 mL of water was dropped, the solution was stirred for 1 hour to obtain a diazotization solution. Separately, a solution of 1.1 g of the pyridone compound (21-2) in 30 mL of methanol was cooled to 5° C., into which the diazotization solution was dropped gradually so as to keep the temperature at 5° C. or less, followed by stirring between 0 and 5° C. for 1 hour. After the end of the reaction, an aqueous solution of sodium carbonate was dropped to neutralize the pH to 6, the solution was extracted with chloroform, and then concentrated. The obtained powder was purified by column chromatography (eluent: chloroform/methanol) to obtain 2.6 g of the compound (21).

[Analysis Results of Compound (21)]

[1] $^{1}$H-NMR (400 MHz, $CDCl_3$, room temperature): δ [ppm]=0.65-0.73 (3H, m), 0.80-0.96 (11H, m), 1.01-1.05 (3H, m), 1.17-1.35 (15H, m), 1.63-1.74 (1H, br), 3.14 (2H, d, J=6.87 Hz), 3.40 (2H, d, J=7.63 Hz), 4.10-4.16 (2H, m), 7.18 (2H, d, J=8.39 Hz), 7.36 (2H, d, J=8.39 Hz), 7.48-7.58 (5H, m), 15.10 (1H, s)

[2] MALDI-TOF-MS mass spectroscopy: m/z=610.818 $(M-H)^-$

Production Examples 22 to 26

Production of Compounds (22) to (26)

The compounds (22) to (26) were synthesized and identified similarly as in the production example 21.

[Production of Yellow Toner]

A yellow toner according to the present invention and a comparative yellow toner were produced by a process described below.

Example 1

A mixture of 12 parts of C. I. pigment yellow 185 (trade name "PALIOTOL Yellow D1155," by BASF SE), 1.2 parts of the compound (1), 120 parts of styrene was dispersed by Attritor (by Mitsui Mining Co., Ltd.) for 3 hours to obtain a pigment dispersion product (1) according to the present invention.

Into a 2 L-four neck flask equipped with a high speed agitation apparatus T. K. HOMO Mixer (by PRIMIX Corporation) 710 parts of ion exchanged water and 450 parts of a 0.1 mol/L aqueous solution of trisodium phosphate were charged and the rotating speed was adjusted to 12,000 rpm and the temperature was raised to 60° C. By adding gradually 68 parts of a 1.0 mol/L aqueous solution of calcium chloride, an aqueous dispersing medium containing calcium phosphate as a minute poorly water soluble dispersion stabilizer was prepared.

| | |
|---|---|
| Pigment dispersion product (1) | 133.2 parts |
| Styrene monomer | 46.0 parts |
| n-Butylacrylate monomer | 34.0 parts |
| Aluminum salicylate compound (Bontron E-88, by Orient Chemical Industries Co., Ltd.) | 2.0 parts |
| Polar resin (polycondensation product of propylene oxide-modified bisphenol A and isophthalic acid, Tg = 65° C., Mw = 10,000, Mn = 6,000) | 10.0 parts |
| Ester wax (Peak temperature of the maximum endothermic peak = 70° C. by DSC measurement, Mn = 704) | 25.0 parts |
| Divinyl benzene monomer | 0.10 parts |

The above composition was heated to 60° C. and dissolved or dispersed homogeneously by a T. K. HOMO Mixer at 5,000 rpm, in which 10 parts of 2,2'-azobis(2,4-dimethylvaleronitrile) as a polymerization initiator was dissolved to prepare a polymerizable monomer composition. The polymerizable monomer composition was added into the aqueous medium and granulated into particles for 15 min maintaining the rotation speed at 12,000 rpm. Thereafter the high speed agitator was switched to a stirrer with propeller blades, and the polymerization was continued at the liquid temperature of 60° C. for 5 hours, then after raising the liquid temperature to 80° C. continued for another 8 hours. After the end of the polymerization reaction the remaining monomer was distilled off at 80° C. under a reduced pressure, and the liquid temperature was cooled to 30° C. to obtain a polymer fine particle dispersion product.

Next, the polymer fine particle dispersion product was transferred to a cleaning vessel, and dilute hydrochloric acid was added with stirring to adjust the pH to 1.5 and stirring was continued for 2 hours. Solid-liquid separation was conducted by a filter to obtain polymer fine particles. Re-dispersion of the polymer fine particles in water and solid-liquid separation were repeated until phosphoric acid containing calcium phosphate and a compound of calcium were adequately removed. Then the polymer fine particles separated at the last solid-liquid separation were dried thoroughly in a drier to obtain a yellow toner base particle (1).

With 100 parts of the obtained yellow toner base particle, 1.00 part of a hydrophobic silica fine powder surface-treated by hexamethyldisilazane (number average primary particle diameter 7 nm), 0.15 parts of a rutile-type titanium oxide fine powder (number average primary particle diameter 45 nm), and 0.50 parts of a rutile-type titanium oxide fine powder (number average primary particle diameter 200 nm) were mixed by a Henschel mixer (by Nippon Coke & Engineering Co., Ltd.) for 5 min in a dry state to obtain a yellow toner (1) according to the present invention.

Examples 2 to 4

Yellow toners (2) to (4) according to the present invention were obtained similarly as in Example 1 except that the compound (1) in Example 1 was changed to 6 parts of the compound (2), 3.6 parts of the compound (8), and 8 parts of the compound (15), respectively.

Examples 5 to 7

Yellow toners (5) to (7) according to the present invention were obtained similarly as in Example 1 except that the usage of C. I. pigment yellow 185 was changed from 12 parts in Example 1 to 10 parts, and the compound (1) was changed to 2 parts of the compound (3), 5 parts of the compound (7), and 7 parts of the compound (9), respectively.

Example 8

A yellow toner (8) according to the present invention was obtained similarly as in Example 1 except that the usage of C. I. pigment yellow 185 was changed from 12 parts in Example 1 to 8 parts, and the compound (1) was changed to 8 parts of the compound (13).

Examples 23 to 25

Yellow toners (23) to (25) according to the present invention were obtained similarly as in Example 1 except that the usage of C. I. pigment yellow 185 was changed from 12 parts in Example 1 to 9 parts, and the compound (1) was changed to 5 parts of the compound (19), 4 parts of the compound (21), and 7 parts of the compound (24), respectively.

Comparative Example 1

A comparative yellow toner (CE1) was obtained similarly as in Example 1 except that the compound (1) in Example 1 was not used.

Comparative Example 2

A comparative yellow toner (CE2) was obtained similarly as in Example 1 except that the compound (1) in Example 1 was changed to a comparative compound (1).

Comparative Example 3

A comparative yellow toner (CE3) was obtained similarly as in Example 1 except that the usage of C. I. pigment yellow 185 was changed from 12 parts in Example 1 to 10 parts, and the compound (1) was changed to 5 parts of a comparative compound (2).

Comparative compounds are shown below.

Comparative compound 1

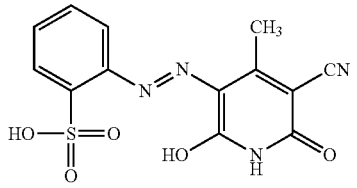

Comparative compound 2

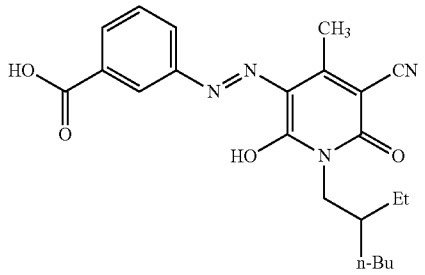

Comparative compound 3

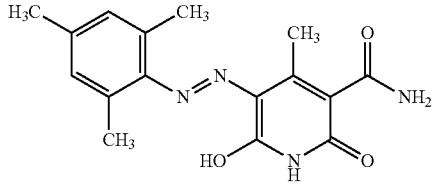

Example 9

82.6 parts of styrene, 9.2 parts of n-butyl acrylate, 1.3 parts of acrylic acid, 0.4 parts of hexanediol acrylate, and 3.2 parts of n-laurylmercaptan were mixed to a homogeneous solution. To the solution an aqueous solution of 1.5 parts of Neogen RK (by DAI-ICHI Kogyo Seiyaku Co., Ltd.) in 150 parts of ion exchanged water was added and dispersed. During stirring gently for 10 min an aqueous solution of 0.15 parts of potassium persulfate in 10 parts of ion exchanged water was added. After nitrogen replacement, an emulsion polymerization was conducted at 70° C. for 6 hours. After the end of the polymerization, the reaction liquid was cooled to room temperature and ion exchanged water was added to yield a resin particle dispersion with the median diameter based on volume of 0.2 μm and the solid concentration of 12.5 mass-%.

100 parts of an ester wax (peak temperature of the maximum endothermic peak=70° C. by DSC measurement, Mn=704) and 15 parts of Neogen RK were mixed with 385 parts of ion exchanged water, and dispersed for about 1 hour by a wet-type jet mill JN100 (by Jokoh Co., Ltd.) to obtain a wax dispersion. The concentration of the wax particle dispersion was 20 mass-%.

100 parts of C. I. pigment yellow 185 and 15 parts of Neogen RK were mixed with 885 parts of ion exchanged water, and dispersed for about 1 hour by a wet-type jet mill JN100 (by Jokoh Co., Ltd.) to obtain a C. I. pigment yellow 185 dispersion.

The median diameter based on volume of the colorant particle in the C. I. pigment yellow 185 dispersion was 0.2 μm, and the concentration of the C. I. pigment yellow 185 dispersion was 10 mass-%.

100 parts of the compound (3) and 15 parts of Neogen RK were mixed with 885 parts of ion exchanged water, and dispersed for about 1 hour by a wet-type jet mill JN100 (by Jokoh Co., Ltd.) to obtain a compound (3) dispersion.

The median diameter based on volume of the colorant particle in the compound (3) dispersion was 0.2 μm, and the concentration of the compound (3) dispersion was 10 mass-%.

160 parts of the resin particle dispersion, 10 parts of the wax dispersion, 10 parts of the C. I. pigment yellow 185 dispersion, 1 part of the compound (3) dispersion, and 0.2 parts of magnesium sulfate were dispersed by a homogenizer (ULTRA-TURRAX T50, by IKA Works GmbH & Co.), followed by heating to 65° C. with stirring. The dispersion was stirred at 65° C. for 1 hour and then observed under a light microscope to confirm that an aggregated particle with the average particle diameter of about 6.0 μm was formed. After adding 2.2 parts of Neogen RK (DAI-ICHI Kogyo Seiyaku Co., Ltd.), the temperature was raised to 80° C. and stirring was continued for 120 min to obtain a fused spherical toner particle. After cooling, the reaction product was filtered, and the filtered solid was washed with 720 parts of ion exchanged water by stirring for 60 min. The solution containing a toner particle was filtered and cleaning was repeated similarly until the electric conductivity of the filtrate decreased to 150 μS/cm or less. After drying by a vacuum drier, a toner base particle (2) was obtained.

With 100 parts of the toner base particle (2) 1.8 parts of a hydrophobized silica fine powder with the specific surface area of 200 $m^2/g$ measured according to a BET method was mixed in a dry state by a Henschel mixer (by Mitsui Mining Co., Ltd.) to obtain a yellow toner (9).

Examples 10 to 12

Yellow toners (10) to (12) according to the present invention were obtained similarly as in Example 9 except that the compound (3) in Example 9 was changed to 6 parts of the compound (5), 3.6 parts of the compound (10), and 8 parts of the compound (11), respectively.

Examples 13 to 15

Yellow toners (13) to (15) according to the present invention were obtained similarly as in Example 9 except that the usage of C. I. pigment yellow 185 in Example 9 was changed to 9 parts, and the compound (3) was changed to 1.8 parts of the compound (4), 4.5 parts of the compound (12), and 7 parts of the compound (9), respectively.

Example 16

A yellow toner (16) according to the present invention was obtained similarly as in Example 9 except that C. I. pigment yellow 185 in Example 9 was changed to 10 parts, and the compound (3) was changed to 10 parts of the compound (16).

Examples 26 to 28

Yellow toners (26) to (28) according to the present invention were obtained similarly as in Example 9 except that the compound (3) in Example 9 was changed to 5 parts of the compound (20), 4 parts of the compound (22), and 6 parts of the compound (25), respectively.

Comparative Example 4

A comparative yellow toner (CE4) was obtained similarly as in Example 9 except that the compound (3) in Example 9 was not used.

Comparative Example 5

A comparative yellow toner (CE5) was obtained similarly as in Example 9 except that the compound (3) in Example 9 was changed to the comparative compound (1).

Example 17

100 parts of a binder resin (a polyester resin: Tg 55° C., acid value 20 mgKOH/g, hydroxyl value 16 mgKOH/g, molecular weight: Mp 4 500, Mn 2,300, Mw 38,000), 5 parts of C. I. pigment yellow 185, 1 part of the compound (6), 0.5 parts of an aluminum 1,4-di-t-butylsalicylate compound, and 5 parts of a paraffin wax (maximum endothermic peak temperature 78° C.) were well mixed in a Henschel mixer (Model: FM-75J, by Mitsui Mining Co., Ltd.), and then kneaded in a twin-screw kneader (Model: PCM-45, by Ikegai Corporation) whose temperature was set at 130° C. (the temperature of the kneaded product at the outlet was about 150° C.) at a feed rate of 60 kg/hr. The obtained kneaded product was cooled and crushed coarsely by a hammer mill, and then ground to fine powders by a mechanical mill (T-250: by Freund-Turbo Corporation) at a feed rate of 20 kg/hr.

The finely ground toner obtained was further classified by a multi-class classifier using a Coanda effect to obtain toner base particles.

With respective 100 parts of the toner base particles 1.8 parts of a hydrophobized silica fine powder with the specific surface area of 200 $m^2/g$ measured according to a BET method was mixed in a dry state by a Henschel mixer (by Mitsui Mining Co., Ltd.) to obtain respective yellow toners (17).

Examples 18 to 20

Yellow toners (18) to (20) according to the present invention were obtained similarly as in Example 17 except that the compound (6) in Example 17 was changed to 5 parts of the compound (11), 0.5 parts of the compound (14), and 2 parts of the compound (17), respectively.

Examples 21 and 22

Yellow toners (21) and (22) according to the present invention were obtained similarly as in Example 17 except that the usage of C. I. pigment yellow 185 in Example 17 was changed to 4 parts, and the compound (6) was changed to 2 parts of the compound (7) and 3.5 parts of the compound (18), respectively.

Examples 29 and 30

Yellow toners (29) and (30) according to the present invention were obtained similarly as in Example 17 except that the usage of C. I. pigment yellow 185 in Example 17 was changed to 7 parts, and the compound (6) was changed to 4 parts of the compound (23) and 5 parts of the compound (26), respectively.

Comparative Example 6

A comparative yellow toner (CE6) was obtained similarly as in Example 17 except that the compound (6) in Example 17 was not used.

Comparative Example 7

A comparative yellow toner (CE7) was obtained similarly as in Example 17 except that the compound (1) in Example 17 was changed to the comparative compound (3).

Comparative Example 8

A comparative yellow toner (CE8) was obtained similarly as in Example 1 except that the usage of C. I. pigment yellow 185 was changed from 12 parts in Example 1 to 6 parts, and the usage of the compound (1) was changed from 1.2 parts to 7 parts.

Comparative Example 9

A comparative yellow toner (CE9) was obtained similarly as in Example 1 except that the usage of C. I. pigment yellow 185 was changed from 12 parts in Example 1 to 8 parts, and the usage of the compound (1) was changed from 1.2 parts to 0.5 parts.

The yellow toners were evaluated as follows. The evaluation results are shown in the following Table 1.

(1) Measurement of weight-average particle diameter D4 and number-average particle diameter D1 of toners The number-average particle diameter (D1) and the weight-average particle diameter (D4) of the toner particles were measured by a particle size distribution analysis according to the Coulter method. The measurements were carried out using Coulter Counter TA-II or Coulter Multisizer II (by Beckman Coulter, Inc.) as a measuring apparatus according to operating manuals of the apparatus. As an electrolytic solution an approx. 1% aqueous solution of sodium chloride was prepared using an EP grade sodium chloride. For example, ISOTON-II (by Coulter Scientific Japan) can be used. Specific measuring procedures are: To 100 to 150 mL of the aqueous electrolytic solution are added as a dispersing agent 0.1 to 5 mL of a surfactant (preferably an alkylbenzenesulfonate), and then 2 to 20 mg of a measurement sample (toner particle). The electrolytic solution in which the sample is suspended is treated for dispersion for about 1 to 3 min by an ultrasonic disperser. The thus obtained dispersion is measured for the volume and number of toners not less than 2.00 μm by the measuring apparatus attached with a 100 μm aperture as the aperture, to calculate a volume-based distribution and a number-based distribution. Then, the number-average particle diameter (D1) was determined from the number-based distribution of a toner particle, the weight-average particle diameter (D4) of a toner particle was determined from the volume-based distribution of the toner particle (the median value of each channel is defined as the representative value of such each channel), and D4/D1 was determined therefrom.

As the channel the following 13 channels are used: 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm.

A: D4/D1 is less than 1.30 (very good granulation property)

B: D4/D1 is not less than 1.30 but less than 1.35 (good granulation property)

C: D4/D1 is not less than 1.35 (poor granulation property)

(2) Measurement of average circularity of toner

Measurement was carried out by a flow-type particle image analyzer "Model FPIA-2100" (by Sysmex Corporation) and a calculation was made according to the following formula.

$$\text{Circle equivalent diameter} = \sqrt{\text{projected area of particle}/\pi} \times 2$$

$$\text{Circularity} = \frac{\text{perimeter of circle having same area as projected area of particle}}{\text{perimeter of particle projected image}}$$

Here, "particle projected area" means an area of a binarized toner particle image, and "perimeter of particle projected image" is defined as the length of an outline formed by connecting the edge points of the toner particle image. The circularity is an index showing unevenness of a particle, and gives 1.000 if a particle is perfectly spherical, and the circularity gives a smaller value if the surface shape becomes more complex.

TABLE 1

| No. | Toner No. | Compound No. | D50 | D4/D1 | Circularity | Percentage less than 2.52 μm [Volume-%] | Percentage not less than 10 μm [Volume-%] | Granulation property |
|---|---|---|---|---|---|---|---|---|
| Example 1 | 1 | Compound (1) | 7.32 | 1.30 | 0.964 | 2.1 | 0.8 | B |
| Example 2 | 2 | Compound (2) | 6.69 | 1.28 | 0.977 | 2.6 | 0.7 | A |
| Example 3 | 3 | Compound (8) | 7.05 | 1.29 | 0.969 | 2.3 | 0.7 | A |
| Example 4 | 4 | Compound (15) | 6.37 | 1.26 | 0.981 | 2.5 | 0.8 | A |
| Example 5 | 5 | Compound (3) | 5.99 | 1.22 | 0.960 | 2.4 | 0.9 | A |
| Example 6 | 6 | Compound (7) | 6.89 | 1.28 | 0.977 | 2.7 | 0.9 | A |
| Example 7 | 7 | Compound (9) | 6.52 | 1.19 | 0.972 | 2.1 | 0.9 | A |
| Example 8 | 8 | Compound (13) | 7.49 | 1.17 | 0.990 | 2.9 | 0.8 | A |
| Example 9 | 9 | Compound (3) | 5.95 | 1.27 | 0.963 | 2.6 | 0.7 | A |
| Example 10 | 10 | Compound (5) | 6.66 | 1.24 | 0.955 | 2.8 | 0.7 | A |
| Example 11 | 11 | Compound (10) | 6.21 | 1.27 | 0.976 | 2.6 | 0.8 | A |
| Example 12 | 12 | Compound (11) | 5.63 | 1.23 | 0.968 | 2.3 | 0.9 | A |
| Example 13 | 13 | Compound (4) | 6.58 | 1.29 | 0.962 | 2.4 | 0.9 | A |
| Example 14 | 14 | Compound (12) | 6.33 | 1.18 | 0.974 | 2.5 | 0.8 | A |
| Example 15 | 15 | Compound (9) | 6.77 | 1.17 | 0.981 | 2.8 | 0.8 | A |
| Example 16 | 16 | Compound (16) | 7.05 | 1.19 | 0.983 | 2.8 | 0.8 | A |
| Example 17 | 17 | Compound (6) | 5.86 | 1.31 | 0.930 | 2.5 | 0.8 | B |
| Example 18 | 18 | Compound (11) | 6.29 | 1.29 | 0.942 | 2.5 | 0.8 | A |
| Example 19 | 19 | Compound (14) | 6.28 | 1.27 | 0.933 | 2.7 | 0.8 | A |

TABLE 1-continued

| No. | Toner No. | Compound No. | D50 | D4/D1 | Circularity | Percentage less than 2.52 μm [Volume-%] | Percentage not less than 10 μm [Volume-%] | Granulation property |
|---|---|---|---|---|---|---|---|---|
| Example 20 | 20 | Compound (17) | 7.01 | 1.30 | 0.930 | 2.9 | 0.7 | B |
| Example 21 | 21 | Compound (7) | 5.34 | 1.26 | 0.944 | 2.1 | 0.8 | A |
| Example 22 | 22 | Compound (18) | 6.72 | 1.28 | 0.936 | 2.2 | 0.9 | A |
| Example 23 | 23 | Compound (19) | 5.96 | 1.28 | 0.977 | 2.5 | 0.7 | B |
| Example 24 | 24 | Compound (21) | 6.01 | 1.20 | 0.981 | 2.4 | 0.8 | A |
| Example 25 | 25 | Compound (24) | 6.66 | 1.19 | 0.978 | 2.3 | 0.8 | A |
| Example 26 | 26 | Compound (20) | 7.01 | 1.29 | 0.983 | 2.6 | 0.7 | B |
| Example 27 | 27 | Compound (22) | 5.57 | 1.30 | 0.974 | 2.4 | 0.9 | A |
| Example 28 | 28 | Compound (25) | 5.98 | 1.28 | 0.969 | 2.5 | 0.7 | A |
| Example 29 | 29 | Compound (23) | 6.23 | 1.16 | 0.929 | 2.7 | 0.8 | A |
| Example 30 | 30 | Compound (26) | 6.41 | 1.18 | 0.934 | 2.2 | 0.8 | A |
| Comparative Example 1 | CE 1 | None | 6.61 | 1.57 | 0.961 | 6.2 | 4.5 | C |
| Comparative Example 2 | CE 2 | Comparative Compound (1) | 6.59 | 1.68 | 0.972 | 5.4 | 5.6 | C |
| Comparative Example 3 | CE 3 | Comparative Compound (2) | 6.39 | 1.38 | 0.986 | 5.1 | 5.2 | C |
| Comparative Example 4 | CE 4 | None | 5.99 | 1.88 | 0.979 | 5.6 | 6.1 | C |
| Comparative Example 5 | CE 5 | Comparative Compound (1) | 7.02 | 1.62 | 0.980 | 5.5 | 6.4 | C |
| Comparative Example 6 | CE 6 | None | 7.11 | 1.74 | 0.928 | 3.5 | 5.8 | C |
| Comparative Example 7 | CE 7 | Comparative Compound (3) | 6.48 | 1.66 | 0.932 | 4.1 | 5.7 | C |
| Comparative Example 8 | CE 8 | Compound (1) | 7.71 | 1.16 | 0.970 | 2.2 | 0.9 | A |
| Comparative Example 9 | CE 9 | Compound (1) | 6.86 | 1.34 | 0.966 | 3.6 | 2.2 | B |

As obvious from Table 1 showing toners by a polymerization process (Examples 1 to 8, Examples 23 to 25, and Comparative Examples 1 to 3), toners by an emulsion aggregation process (Examples 9 to 16, Examples 26 to 28, and Comparative Examples 4 to 5), and toners by a grinding process (Examples 17 to 22, Examples 29 to 30, and Comparative Examples 6 to 7) different in production processes, a yellow toner obtainable according to the present invention is superior in terms of the granulation property compared to a corresponding comparative yellow toner, irrespective of the production processes. Further, both the percentages of coarse powders and fine powders are decreased significantly.

(2) Evaluation of Image Sample Having Used Yellow Toner

Using 7 of the above toners, image samples were produced and the image properties described below were evaluated comparatively. For comparing the image properties, as an image forming apparatus (hereinafter abbreviated as "LBP") a modified machine of LBP-5300 (by Canon Inc.) was used and a sheet feeding endurance test was carried out. As for the modification, a developing blade in a process cartridge (hereinafter abbreviated as "CRG") was changed to an SUS blade with the thickness of 8 μm, and with respect to developing bias applied to a developing roller, which is a toner carrier, application of the blade bias of −200 V was made possible.

For evaluation, a CRG individually filled with each yellow toner was prepared for each evaluation item. Then each CRG filled with each toner was set at the LBP, and the following evaluation items were individually evaluated.

[Evaluation of Optical Density (OD) of Toner]

In a normal environment (temperature 25° C./humidity 60% RH), 16 grey-scale image samples adjusted to the maximum toner coating amount of 0.45 mg/cm$^2$ were produced by a modified color copying machine CLC-1100 (by Canon Inc., the fixing oil coating system was removed.). On such an occasion, as a substrate for the image sample, a CLC color copying paper (by Canon Inc.) was used. The obtained image sample was analyzed by SpectroLino (by Gretag Machbeth). With respect to analysis results, evaluations were conducted based on yellow optical density OD (Y) at a grey-scale with the maximum toner coating amount. In this connection, if the dispersibility of a colorant is better, the optical density of a toner is higher.

A: OD (Y) is 1.6 or higher (very high colorability)

B: OD (Y) is not less than 1.5 but less than 1.6 (high colorability)

C: OD (Y) is less than 1.5 (low colorability)

[Light Resistance]

Using the obtained toners image samples were produced. The obtained prints were placed in an Atlas Weather-Ometer (Ci4000, by Toyo Seiki Seisaku-Sho, Ltd.) and exposed for 100 hours. The selected conditions were Black Panel: 50° C., Chamber: 40° C., Humidity: 60%, and Irradiance (at 340 nm): 0.39 W/m$^2$. The test sheets before and after the irradiation were analyzed by SpectroLino (by Gretag Machbeth). Optical density and chromaticity (L*, a*, b*) in the L*a*b* color system were measured. The color difference (ΔE) was calculated from the measured values of color properties according to the following formula.

$$\text{Color difference } (\Delta E)=\sqrt{\{(a^*\text{before test}-a^*\text{after test})^2+(b^*\text{before test}-b^*\text{after test})^2+(L^*\text{before test}-L^*\text{after test})^2\}}$$

Evaluation was conducted based on the following, and rated as good light resistance if ΔE was less than 10.

A: ΔE is less than 5 (very good light resistance)

B: ΔE is not less than 5 but less than 10 (good light resistance)

C: ΔE is 10 or more (poor light resistance)

TABLE 2

| No. | Toner No. | Compound No. | Optical density | Rating | Light resistance | Rating |
|---|---|---|---|---|---|---|
| Example 1 | 1 | Compound (1) | 1.81 | A | 4.8 | A |
| Example 2 | 2 | Compound (2) | 1.60 | A | 4.4 | A |
| Example 3 | 3 | Compound (8) | 1.76 | A | 3.6 | A |
| Example 4 | 4 | Compound (15) | 1.74 | A | 4.3 | A |
| Example 5 | 5 | Compound (3) | 1.60 | A | 4.6 | A |
| Example 6 | 6 | Compound (7) | 1.63 | A | 4.7 | A |
| Example 7 | 7 | Compound (9) | 1.69 | A | 2.0 | A |
| Example 8 | 8 | Compound (13) | 1.71 | A | 3.8 | A |
| Example 9 | 9 | Compound (3) | 1.66 | A | 3.3 | A |
| Example 10 | 10 | Compound (5) | 1.61 | A | 2.6 | A |
| Example 11 | 11 | Compound (10) | 1.82 | A | 4.9 | A |
| Example 12 | 12 | Compound (11) | 1.64 | A | 3.5 | A |
| Example 13 | 13 | Compound (4) | 1.66 | A | 2.9 | A |
| Example 14 | 14 | Compound (12) | 1.76 | A | 3.4 | A |
| Example 15 | 15 | Compound (9) | 1.67 | A | 3.2 | A |
| Example 16 | 16 | Compound (16) | 1.78 | A | 3.0 | A |
| Example 17 | 17 | Compound (6) | 1.69 | A | 4.2 | A |
| Example 18 | 16 | Compound (11) | 1.79 | A | 2.1 | A |
| Example 19 | 19 | Compound (14) | 1.62 | A | 4.0 | A |
| Example 20 | 20 | Compound (17) | 1.65 | A | 4.1 | A |
| Example 21 | 21 | Compound (7) | 1.88 | A | 3.8 | A |
| Example 22 | 22 | Compound (18) | 1.71 | A | 3.1 | A |
| Example 23 | 23 | Compound (19) | 1.77 | A | 3.9 | A |
| Example 24 | 24 | Compound (21) | 1.69 | A | 3.2 | A |
| Example 25 | 25 | Compound (24) | 1.81 | A | 2.6 | A |
| Example 26 | 26 | Compound (20) | 1.80 | A | 3.1 | A |
| Example 27 | 27 | Compound (22) | 1.75 | A | 3.8 | A |
| Example 28 | 28 | Compound (25) | 1.68 | A | 2.2 | A |
| Example 29 | 29 | Compound (23) | 1.73 | A | 2.6 | A |
| Example 30 | 30 | Compound (26) | 1.75 | A | 2.9 | A |
| Comparative Example 1 | CE 1 | None | 1.54 | B | 1.8 | A |
| Comparative Example 2 | CE 2 | Comparative Compound (1) | 1.24 | C | 15.1 | B |
| Comparative Example 3 | CE 3 | Comparative Compound (2) | 1.36 | C | 16.3 | B |
| Comparative Example 4 | CE 4 | None | 1.58 | B | 2.0 | A |
| Comparative Example 5 | CE 5 | Comparative Compound (1) | 1.55 | B | 16.8 | C |
| Comparative Example 6 | CE 6 | None | 1.52 | B | 1.6 | A |
| Comparative Example 7 | CE 7 | Comparative Compound (3) | 1.22 | C | 20.7 | C |
| Comparative Example 8 | CE 8 | Compound (1) | 1.81 | A | 10.1 | C |
| Comparative Example 9 | CE 9 | Compound (1) | 1.56 | B | 2.1 | A |

As obvious from Table 2 showing toners by a polymerization process (Examples 1 to 8, Examples 23 to 25, and Comparative Examples 1 to 3), toners by an emulsion aggregation process (Examples 9 to 15, Examples 26 to 28, and Comparative Examples 4 to 5), and toners by a grinding process (Examples 16 to 21, Examples 29 and 30, and Comparative Examples 6 to 7) different in production processes, a yellow toner obtainable according to the present invention is superior in terms of both of optical density and light resistance compared to a corresponding comparative yellow toner. Especially concerning the light resistance, significant effect can be recognized by the use of a compound represented by the general formula (1) of the present invention.

Further, as obvious from Example 1 and Comparative Examples 8 to 9, a yellow toner obtainable according to the present invention is, compared to a corresponding comparative yellow toner, superior in terms of both of optical density and light resistance. Especially concerning the light resistance, significant effect can be recognized by the use of a composition ratio according to the present invention.

In general a pigment exists as an aggregate with a certain dimension. Consequently, a factor, which promotes degradation, may affect a surface layer to deteriorate only the surface layer. However, such a degradation promoting factor cannot reach a pigment inside the aggregate. As a result, a degraded portion of the surface layer conceivably acts as a protective film for the pigment inside the aggregate to enhance the light resistance. On the other hand, a dye is dissolved or dispersed uniformly in a medium. Consequently, a dye is conceivably directly affected by the degradation promoting factor and more easily deteriorated to give low light resistance.

It can be inferred from Tables 1 and 2, although specific reasons have not been clarified, that self-aggregation of C. I. pigment yellow 185 is suppressed by an intermolecular interaction between C. I. pigment yellow 185 and a compound represented by the general formula (1) in the present invention. In other words, C. I. pigment yellow 185 and a compound represented by the general formula (1) conceivably come into an appropriately mixed state, so that self-aggregation of C. I. pigment yellow 185 is suppressed and micro-dispersion of the same can be attained. Changing the viewpoint, a compound represented by the general formula (1) has conceivably entered somehow between the micro-dispersed C. I. pigment yellow 185. As a result, a compound represented by the general formula (1) can be protected by C. I. pigment yellow 185 against the degradation promoting factor, so that the light resistance of the compound represented by the general formula (1) is conceivably enhanced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-049897, filed Mar. 7, 2012, which is hereby incorporated by reference herein in its entirety.

The invention claimed is:

1. A yellow toner comprising toner particles which contain at least a binder resin, a wax and a colorant, wherein the colorant comprises C. I. pigment yellow 185 and a compound represented by the general formula (1):

General formula (1)

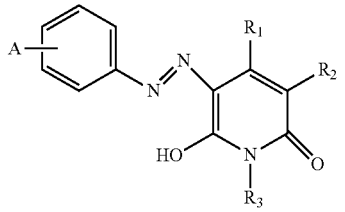

wherein,

A represents —CON($R_4$)$R_5$, $R_4$ represents a hydrogen atom or an alkyl group, and $R_5$ represents an alkyl group, $R_1$ represents an alkyl group, an aryl group, or an amino group, $R_3$ represents an alkyl group, $R_2$ represents a hydrogen atom, a cyano group, a carboxylic acid group, a carboxylate ester group, a carboxylic acid amide group, or a carbamoyl group, and the content of the compound represented by the general formula (1) with respect to 100 parts by mass of the C.I. pigment yellow 185 is 10 to 100 parts by mass.

2. A process for producing a yellow toner comprising:

preparing a polymerizable monomer composition comprising a polymerizable monomer, C. I. pigment yellow 185, a compound represented by the general formula (1), and a wax;

dispersing the polymerizable monomer composition into an aqueous medium to form particles of the polymerizable monomer composition by granulation; and polymerizing the polymerizable monomer in the particles using a polymerization initiator to produce toner particles, wherein the yellow toner comprises toner particles which contain at least a binder resin, a wax and a colorant, wherein the colorant comprises C.I. pigment yellow 185 and a compound represented by the general formula (1):

General formula (1)

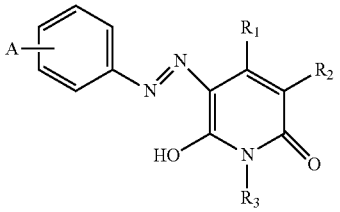

wherein,

A represents —CON($R_4$)$R_5$, $R_4$ represents a hydrogen atom or an alkyl group, and $R_5$ represents an alkyl group, $R_1$ represents an alkyl group, an aryl group, or an amino group, $R_3$ represents an alkyl group, and $R_2$ represents a hydrogen atom, a cyano group, a carboxylic acid group, a carboxylate ester group, a carboxylic acid amide group, or a carbamoyl group.

3. A process for producing a yellow toner comprising:

preparing a solvent-containing composition by mixing a binder resin, C. I. pigment yellow 185, a compound represented by the general formula (1), and a wax in an solvent;

dispersing the solvent-containing composition into an aqueous medium to form particles of the solvent-containing composition by granulation; and removing the solvent from the particles to produce toner particles, wherein the yellow toner comprises toner particles which contain at least a binder resin, a wax and a colorant, wherein the colorant comprises C.I. pigment yellow 185 and a compound represented by the general formula (1):

General formula (1)

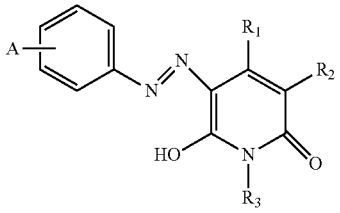

wherein,

A represents —CON($R_4$)$R_5$, $R_4$ represents a hydrogen atom or an alkyl group, and $R_5$ represents an alkyl group, $R_1$ represents an alkyl group, an aryl group, or an amino group, $R_3$ represents an alkyl group, and $R_2$ represents a hydrogen atom, a cyano group, a carboxylic acid group, a carboxylate ester group, a carboxylic acid amide group, or a carbamoyl group.

* * * * *